US005829953A

United States Patent [19]

Fehringer et al.

[11] Patent Number: 5,829,953

[45] Date of Patent: Nov. 3, 1998

[54] BILLING STATEMENT SYSTEM

[75] Inventors: Robert L. Fehringer, Camino; Christian E. Tammi, El Dorado Hills; Marc J. Fagan, Davis; Daniel M. Saldana, Rancho Cordova; Charles E. Preston, Orangevale; Jonathan D. Emigh, Somerset; Steve Johnson, Antelope; Chris Jones, Folsom, all of Calif.

[73] Assignee: International Billing Services, Inc., Rancho Cordova, Calif.

[21] Appl. No.: 641,503

[22] Filed: May 1, 1996

Related U.S. Application Data

[63] Continuation-in-part of Ser. No. 588,714, Jan. 19, 1996, and a continuation-in-part of Ser. No. 588,715, Jan. 19, 1996.

[51] Int. Cl.[6] ..... B65H 41/00

[52] U.S. Cl. ..... 414/789.1; 270/58.27

[58] Field of Search ..... 270/1.1, 58.27; 283/66.2, 116; 414/788.1, 788.9, 789.9

[56] References Cited

U.S. PATENT DOCUMENTS

| | | | |
|---|---|---|---|
| D. 385,298 | 10/1997 | Hansen . | |
| D. 385,910 | 11/1997 | Hansen . | |
| D. 390,599 | 2/1998 | Hansen . | |
| 1,946,751 | 2/1934 | McCarthy . | |
| 2,010,724 | 8/1935 | Kelly | 283/66.2 |
| 3,977,597 | 8/1976 | Wise et al. . | |
| 4,093,117 | 6/1978 | Morse . | |
| 4,502,713 | 3/1985 | Conti . | |
| 4,585,160 | 4/1986 | Fiske, II . | |
| 4,706,877 | 11/1987 | Jenkins . | |
| 4,733,359 | 3/1988 | Luperti et al. | 364/478 |
| 4,743,747 | 5/1988 | Fougere et al. . | |
| 4,784,379 | 11/1988 | Vander Syde et al. | 270/55 |
| 4,817,042 | 3/1989 | Pintsov | 364/478 |
| 4,875,668 | 10/1989 | Spyro | 270/45 |
| 4,893,257 | 1/1990 | Dominguez, Jr. et al. . | |
| 5,131,075 | 7/1992 | Wilkes et al. . | |
| 5,316,279 | 5/1994 | Corono et al. | 270/1.1 |
| 5,603,529 | 2/1997 | Briendel | 283/116 |
| 5,659,481 | 8/1997 | Qutub et al. | 364/478.08 |

*Primary Examiner*—Karen M. Young
*Assistant Examiner*—Gregory A. Morse
*Attorney, Agent, or Firm*—James M. Ritchey

[57] ABSTRACT

A billing statement system comprising a billing statement having a plurality of sheets or pages of multiple lengths or which are otherwise of multiple sizes and/or shapes. The billing statement preferably comprises a plurality of sheets wherein at least one sheet is of different, generally larger, size than the other sheets, and in which the larger sheet has a first region with a consumer's mailing address on one side and a provider's mailing address on the reverse side, and a second region which contains detail or summary information on the charges due. The billing statement system includes a collator apparatus for collating billing statements having a plurality of sheets of multiple lengths, and a folder apparatus for folding collated billing statements having a plurality of sheets of multiple lengths.

11 Claims, 13 Drawing Sheets

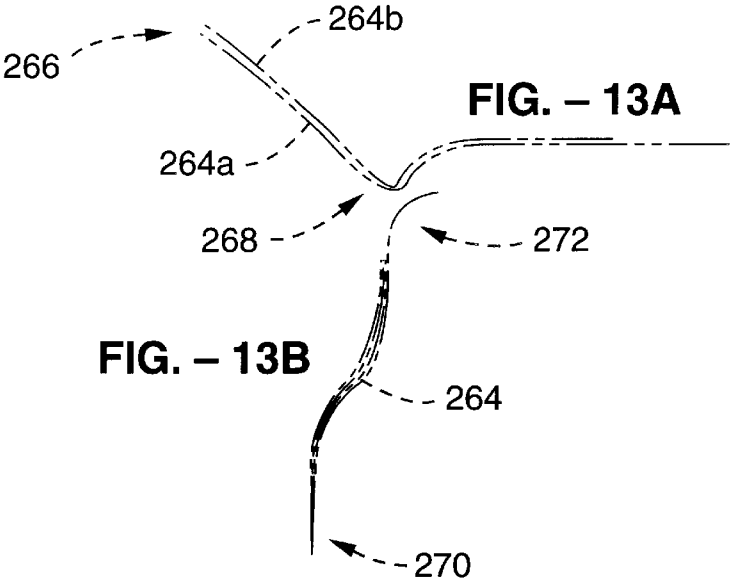
FIG. – 13A
FIG. – 13B
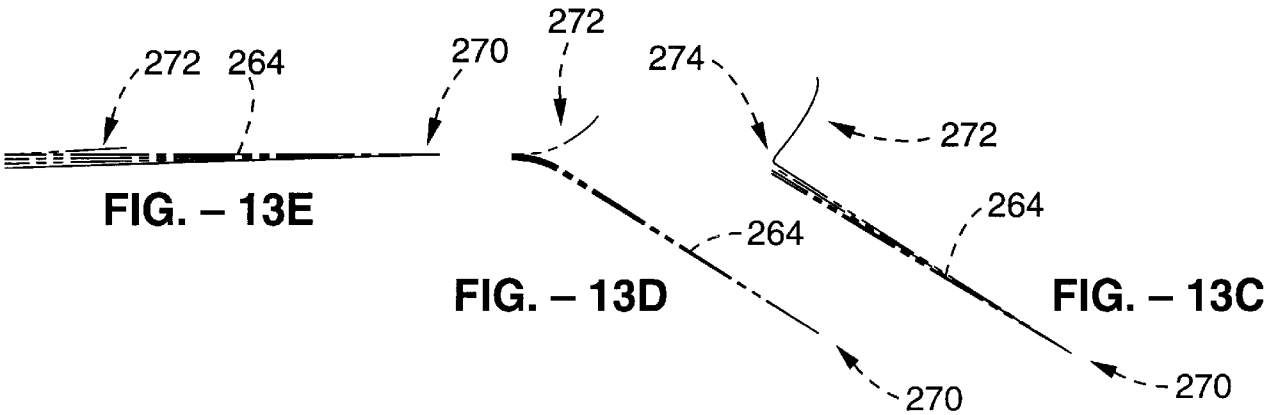
FIG. – 13C
FIG. – 13D
FIG. – 13E

BILLING STATEMENT SYSTEM

CROSS-REFERENCE TO RELATED APPLICATIONS

This is a continuation-in-part of copending applications Ser. No. 08/588,714 filed on Jan. 19, 1996 and Ser. No. 08/588,714 filed on Jan. 19, 1996.

BACKGROUND OF THE INVENTION

1. Field of the Invention

A versatile document system is provided for use in informing a consumer of charges due. More specifically, a billing statement system is disclosed for use with a billing statement comprising a plurality of sheets wherein at least one sheet is of different, generally larger, size than the other sheets, and in which the larger sheet has a first region with a provider's mailing address on one side and a customer's mailing address on the reverse side, and a second region which contains detail or summary information on the charges due. Collator and folder means are provided to handle the combination of different sized sheets.

2. Description of the Background Art

Periodic billing statements, such as those prepared in typical monthly billing operations for customers of credit card, telephone, utility and other providers, each generally include a plurality of pages, forms, or sheets of printed material which are ultimately sent to a customer in a single envelope. The billing statement must be correctly organized, collated, folded, and inserted into envelopes for mailing to customers.

Over the years, various types of forms have been patented. U.S. Pat. No. 1,946,751 discloses a bank check postcard folder. Included is a bank check with an integral statement in which a window in the statement serves to display the address of the payee.

U.S. Pat. Nos. 3,977,597, 4,093,117, 4,502,713, 4,585,160, and 4,706,877 all relate various types of statement mailer and return means devices.

Disclosed in U.S. Pat. No. 4,743,747 is a postage and mailing information applying system. The system applies to an envelope an encrypted message based upon postage and mail address information. A high speed sorter may utilize the encrypted message for authentication purposes.

Several limited printing methods and devices exist for scanning and printing forms in variable directions. U.S. Pat. No. 4,893,257, for example, provides a character generator with multidirectional scan and print capability.

An important deficiency in prior art billing statement systems is the inability to provide billing statements which contain at least one sheet or form in a plurality of sheets which is longer, wider, or otherwise differently sized and/or shaped than the other sheets of the statement. Background art billing statement systems additionally do not provide for the processing of billing statements into finished mailing pieces when one or more sheets of the billing statement is longer, shorter, or otherwise of different dimension than the remainder of the sheets. For example, background art billing statement systems do not provide means for quickly and efficiently collating billing statements comprising multiple sheets or pages having varying lengths and/or widths so that the collated sheets of the statement may subsequently be folded and inserted into envelopes. The different lengths of the individual sheets of the statement make it difficult to quickly and accurately collate the entire statement for subsequent folding and envelope insertion. Incorrect collation of the multiple sheets causes uneven folding and detracts from the overall appearance of the billing statement, which can lead to customer dissatisfaction. Incorrect collating also can cause jams or other errors in downstream folding, envelope insertion, and other processing operations, leading to system shutdown and delays while the jam is cleared.

Currently known billing statement systems additionally do not provide means for quickly and accurately folding billing statements comprising multiple sheets or pages wherein one or more sheets are of different length or width than the other sheets. A variety of folding systems and devices for billing statement preparation are known and used for high speed folding of a plurality of sheets for subsequent envelope insertion and other processing. Typically, a billing statement is folded in half or in thirds by a buckle folder or other conventional folding device to provide a folded statement suitable for insertion into standard billing envelopes. In a billing statement in which there are multi-length sheets, however, there exist complications which can prevent accurate folding. For example, in a billing statement wherein one sheet of the statement is longer than the others, when the statement has been folded once or in half, there are still an additional portion of the longer sheet or form which protrudes out from the folded packet and which must still undergo folding in order to fit into the envelope. A conventional buckle folder may be used in folding a multi-length and multi-page billing statement, however, a specifically designed folder is preferred. A standard buckle folder often folds over the protruding portion or tab of the longer, outer sheet into the folded statement packet and causes a slight folding of the tips of the shorter, inner sheets. A single long sheet is easily folded by a standard buckle folder.

Accordingly, there is a need for a billing statement system having at least one of a plurality of sheets which is differently sized and/or shaped than the other sheets, which provides means for collating the billing statement, which provides means for folding the billing statement, and which avoids processing problems due to improperly collated or folded billing statements. The present invention satisfies these needs, as well as others, and generally overcomes the deficiencies present in the background art.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

An object of the present invention is to provide a billing statement system with a billing statement comprising a plurality of sheets, with at least one of the plurality of sheets being differently sized and/or shaped than the other sheets.

Another object of the present invention is to provide a billing statement system which allows for collating of a billing statement wherein one or more of a plurality of sheets are differently sized and/or shaped than the other sheets.

A further object of the present invention is to provide a billing statement system which allows for folding of a billing statement wherein one or more of a plurality of sheets are differently sized and/or shaped than the other sheets.

Still another object of the present invention is to provide a billing statement system wherein a sheet of the billing statement which is longer than the other sheets includes a detachable portion for remittance with a payment, and a standard-sized portion for retention by billing recipients.

Yet a further object of the present invention is to provide a billing statement system wherein a longer first sheet of the billing statement includes a first region with a provider's mailing address on one side and a customer's mailing address on the reverse side and usually flipped 180° in orientation, and a second region which contains detail or summary information on the charges due, usually summary information in side-by-side fashion.

Other objects, advantages, and novel features of the present invention will become apparent from the detailed description that follows, when considered in conjunction with the associated drawings.

Disclosed is a billing statement system for use in informing consumers or customers of charges due. In its most general terms, the billing statement system of the present invention comprises a billing statement having a plurality of sheets or pages wherein at least one sheet is of a different size and/or shape than other sheets in the statement, means for collating the billing statement, and means for folding the billing statement.

By way of example and not of limitation, the billing statement comprises sheets of multiple lengths, and includes at least one sheet which is generally longer than the other previous or following sheets of the statement. Preferably, the billing statement has a first or outer sheet or sheets which are longer than the subsequent or following inner sheets of the statement. The first, longer sheet preferably includes a first region wherein a provider's mailing address is located on a first side, and a second or reverse side wherein a customer's mailing address is located. The first side of the first region also preferably includes a billing date, an amount due, and a customer account number. The longer sheet also preferably includes a second region wherein are located detail or summary information on the charges due by a consumer or customer. The second region also generally includes first and second sides. The first region is preferably shorter than the second region, and comprises a detachable portion which is removed from the second region and returned or mailed to the billing entity by the customer, together with a payment. The second region containing the detailed accounting or summary information is retained by the customer for record keeping purposes. The shorter sheets may include additional printed account summary information, notices, advertising material, or other printed subject matter. One or more return envelopes, which are generally shorter than the sheets of the billing statement, may also be included in the billing statement.

The collator means of the invention preferably comprises a collating tray, input means for providing the plurality of sheets or pages of the billing statement to the collating tray, stopping means for registering at least one edge of each of the plurality of sheets received from the input means, and means for removing the collated statements from the collating tray, which is preferably in the form of pinch roller means. The collating means preferably also comprises output means for receiving collated billing statements from the removing means and collating tray, means for actuating the stopping means and removing means, and control means for directing the operation of the input means and actuating means.

The collating tray preferably has a first end adjacent to the input means, and a second end adjacent to the stopping means and pinch roller means, with the second end of the collating tray preferably being positioned lower than the first end of the collating tray. The stopping means preferably comprises a stopper with one or more stop bars which move in a vertical fashion between a first position wherein the stop bars provide a surface against which an edge of the sheets of the billing statement may register during collation, and a second position which allows removal of the collated billing statement from the collating tray by the pinch roller means. The pinch roller means preferably includes a plurality of upper and lower pinch rollers which are brought together to frictionally engage the collated sheets of the billing statement and remove the statement from the collating tray. Preferably, the stopping means and pinch roller means are interfaced together mechanically, electrically, by software, or by other means, so that both the stopping means and pinch roller means are actuated together by the actuating means, with the upper and lower pinch rollers coming together to engage and remove the collated billing statement at generally the same time that the stop bars move to allow the collated billing statement to leave the collating tray. The collating tray includes means for variably adjusting its width so that billing statements with sheets of varying width as well as varying length may be collated. The control means preferably comprises a system controlling computer which includes or is interfaced with data storage means. The data storage means contains a controlling data packet for the bulk mailing job which includes the information regarding the number of pages or sheets and the order of the sheets included in each billing statement. The control means is interfaced with the input means and actuating means of the collating apparatus, which are directed in their operation by system controlling software. The input means and output means preferably comprises standard belt and pulley driven document transport systems which are suitably positioned to provide sheets of the billing statements to the collating tray and receive collated billing statements from the pinch roller means.

The folder means of the invention preferably comprises a plurality of roller means for folding sheets, a plurality of gate means, adjacent to the roller means, and means for ejecting folded sheets out of the gate means and roller means. The folder means also preferably comprises input means for providing sheets of the billing statement to the plurality of roller means, and output means for removing folded sheets from the plurality of roller means. The folder means generally operates under the direction of computer control means, and preferably includes sensor means, interfaced with the control means, for detecting the location of sheets relative to the plurality of roller means and plurality of gate means. The computer control means associated with the folder means is preferably the same as that used for the control means of the collator means.

The roller means generally comprises a plurality of conventional folder rollers (such as those found in a traditional buckle folder) which may be adjustably positioned relative to each other, depending upon the type of folding operation to be carried out with the subject invention. The gate means preferably comprises one or more conventional folder gates and their associated gate assemblies, and are positioned adjacent to the folder rollers. The folder gates may be positionally adjusted according to a particular folding operation. The means for ejecting folded sheets out of the roller means and/or gate means preferably comprises a kicker plate coupled to an actuator, with the actuator being associated with one of the folder gates. The input means and output means preferably comprises standard belt and pulley driven document transport systems which are suitably positioned to provide sheets into the folder rollers and receive folded sheets therefrom. The control means is preferably a system control computer, as related above, which directs actuation of the kicker plate. The sensing means are interfaced with the control means and generally comprise an encoder for timing of the kicker gate actuation based on rotational values, as well as a plurality of photocell sensors or equivalent devices located adjacent the input means, output means, and folder rollers, which track and verify the position of billing statements during folding.

In the billing statement system of the present invention, the individual printed sheets and forms for each of a plurality of billing statement are sequentially produced by conventional printer means and provided to the collator means of the invention by standard mechanical transfer means. The input means of the collator means directs the printed sheets of each billing statement to the collating tray under the direction of the control means and according to the information in the controlling data packet. As each sheet is placed within the collating tray, it is directed towards the stop bars whereupon the leading edge of the sheet is registered. Guide means, preferably in the form of a guide bar and suitably placed deflectors, aid in directing and positioning the sheets of the billing statement so that they register against the stop bars. Sensing means which are interfaced with the control means monitor the movement of the billing statement sheets and indicate when each sheet enters the collating tray from the input means. When the sensing means has sensed or detected that each sheet for a particular billing statement has entered the collating tray and registered against the stop bars, the actuating means is directed by the control means to lift the stop bars and bring the upper and lower pinch rollers together on the collated statement, removing the statement from the collating tray and placing the statement in the output means, from which the statement is then preferably directed the folder means or to other downstream processing operations such as, envelope insertion, postage metering, an the like. When the sensing means indicates that the collated statement has cleared the collating tray, the control means directs the input means to provide the sheets or pages of the next statement to the collating tray, and the above procedure is repeated.

The output means of the collator means is generally interfaced with the input means of the folder means. The collated billing statements from the collator means are generally aligned or registered along the leading edge, with a portion of the longer sheet or sheets of the billing statement generally located on the trailing edge. The collated billing statements are directed by input means to the folder rollers of the folder means. Each billing statement is received by a pair of folder rollers and directed along a folding path towards a first folder gate. As the leading edges of the sheets of the billing statement come into contact with the first folder gate, movement of the sheets in the direction of the gate is blocked, and the action of the folder rollers causes the sheets of the billing statement to buckle and fold. The folder rollers and folder gates may be adjustably positioned to control the folding path of the sheets and thus the location of the folds and number of folds produced in the billing statement. Preferably the folder rollers and folder gates are positioned to generally fold the billing statement in half to form a folded packet, with the end of the longer sheet or sheets of the billing statement protruding out of the packet. The folded billing statement packet, with the fold preferably located on the leading edge, is then directed by a series of folder rollers, which passively engage or grip the billing statement, along the folding path towards the kicker plate or other ejecting means, upon which the folded edge of the packet comes into contact. The kicker plate blocks travel of the folded billing statement packet. The kicker plate, at the direction of the system controller, then ejects the folded billing statement, causing the protruding portion of the longer sheet or sheets of the statement to buckle and fold, preferably along a perforation, rather than be forced back into the folder rollers. The protruding portion of the longer sheet of the billing statement is thus folded by the ejecting action of the kicker gate. Following the action of the kicker gate, the shorter sheets of the billing statement are not gripped by the folder rollers, and therefor do not undergo unwanted folding. The control means tracks the position of the billing statement by monitoring the encoder of the folder means, which informs the control means of the position of the machine cycle of the folder means and thus the position of the statement. The photocell sensor verify that billing statements have entered and exited the folder means. The output means may direct folded billing statements to other processing operations, such as envelope insertion of the folded billing statements.

BRIEF DESCRIPTION OF THE DRAWINGS

FIGS. 13A–13E show a billing statement in accordance with the invention undergoing steps of a folding operation.

DESCRIPTION OF THE PREFERRED EMBODIMENT

Figure 1:
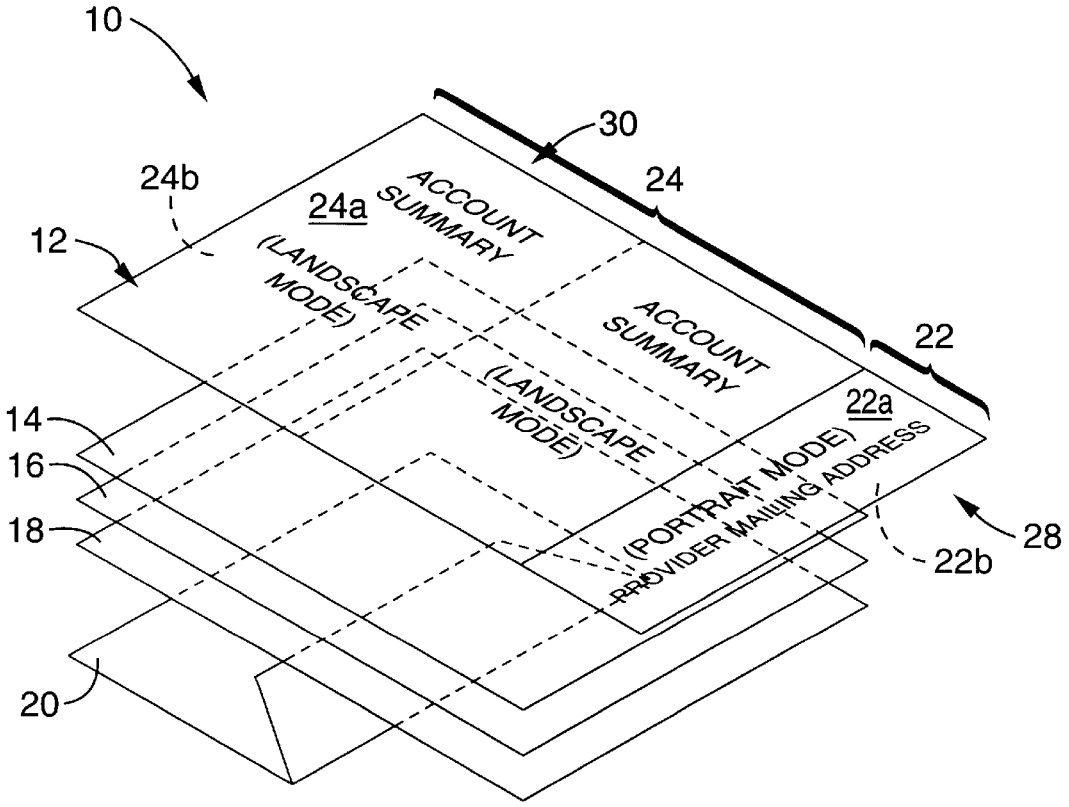
FIG. 1 is an exploded perspective view of a billing statement in accordance with the present invention.

Referring now to FIG. 1 through FIG. 14, there is shown a preferred embodiment of a billing statement system in accordance with the invention. It will be appreciated that the billing statement system may vary as to configuration and as to details without departing from the basic concepts as disclosed herein.

Referring first to FIG. 1 to FIG. 3A and FIG. 3B, a billing statement 10 in accordance with present invention is generally shown which is suitable for use in customer billing by providers of various services such as credit card, telephone, utility, cable television, or other services which involve periodic billing of customers. Billing statement 10 includes a plurality of sheets, forms or pages 12, 14, 16, 18, with outer sheet 12 being generally longer than inner sheets 14, 16, 18. A return envelope 20, which is generally shorter in length than outer sheet 12 and inner sheets 14, 16, 18 may also be included with billing statement 10. Additional inserts (such as advertisements, fliers, coupons, and the like) may also be included in the billing statement.

Figure 2:
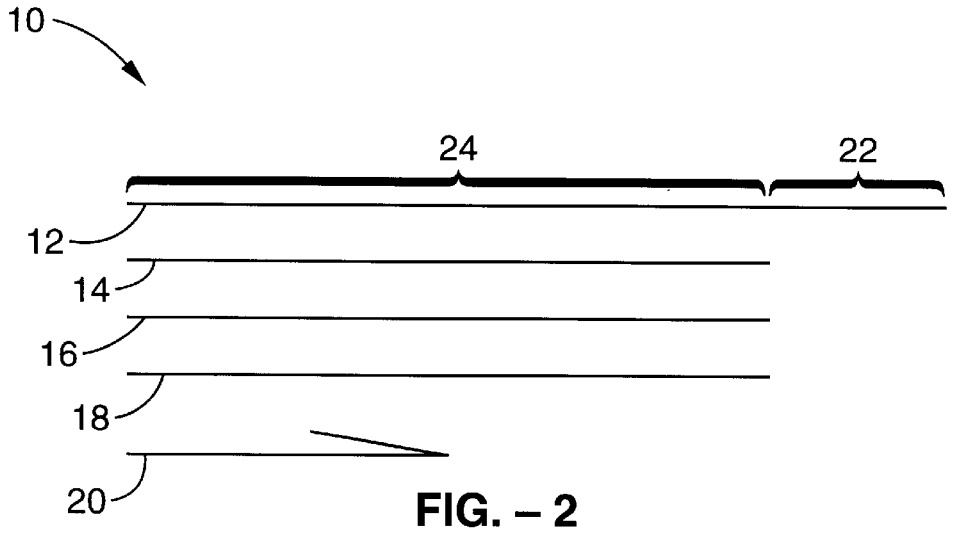
FIG. 2 is a side elevation view of the billing statement of FIG. 1.
Figure 3A:
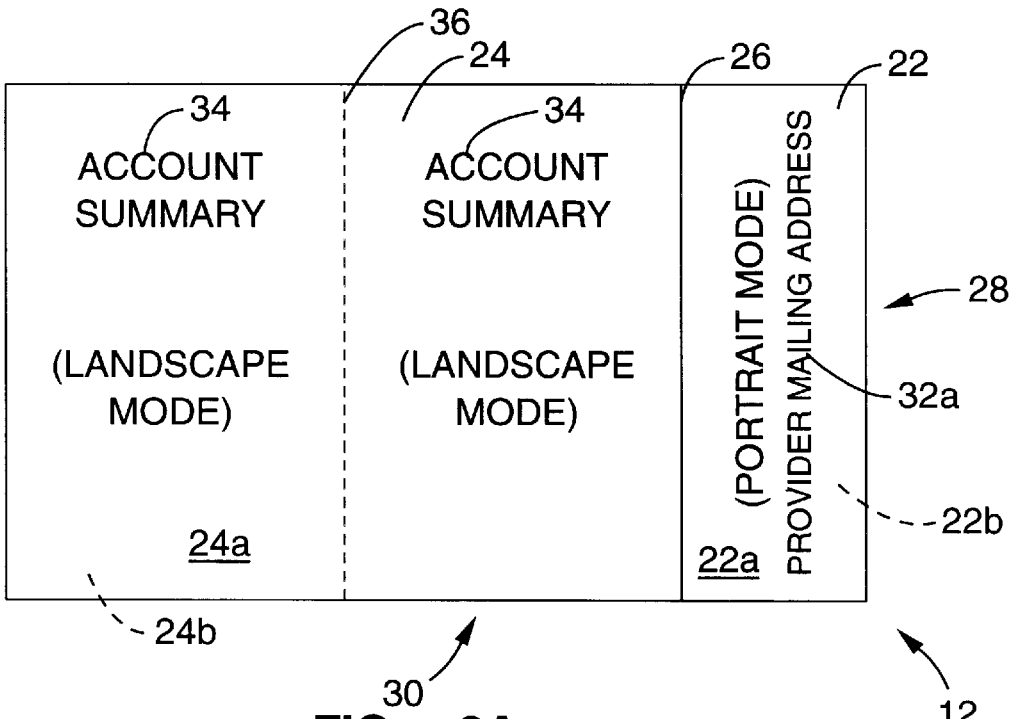
FIGS. 3A and 3B are top and bottom plan views respectively of the longer first or top sheet of the billing statement of FIG. 1.
Figure 3B:
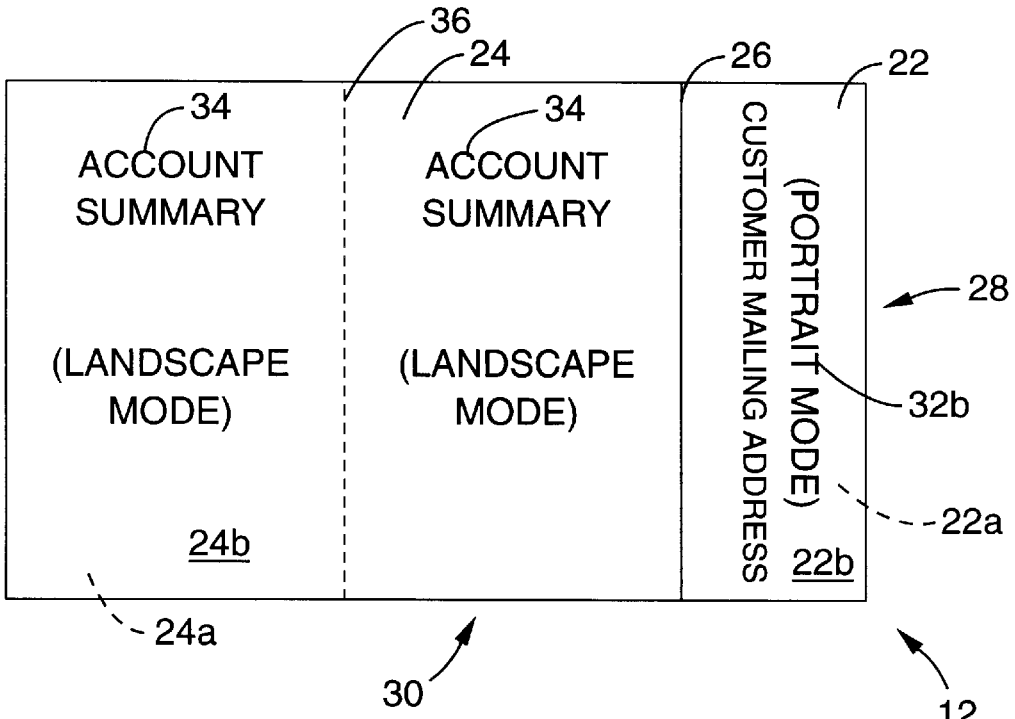

Referring more particularly to FIG. 3A and FIG. 3B as well as FIG. 1 and FIG. 2, the longer, outer sheet 12 preferably includes first and second regions 22, 24, with first region 22 including a first or front side 22*a* and a second or reverse side 22*b*, and second region 24 likewise including a first or front side 24*a* and a second or reverse side 24*b*. First and second regions 22, 24 preferably are detachably joined together by a frangible portion or perforation line 26. First region 22 preferably includes printed material in a portrait mode wherein printed alphanumeric symbols are arranged in lines generally parallel to the shorter edge 28 and perpendicular to the longer edge 30 of sheet 12. Second region 24 preferably includes printed material in a landscape mode wherein the printed alphanumeric symbols are arranged in lines generally parallel to the longer edge 30 and perpendicular to shorter edge 28 of sheet 12. Printed general billing information and/or a provider's return mailing address 32*a* are preferably included on the first side 22*a* of first region 22, and a printed customer's mailing address 32*b* is preferably included on second side 22*b* of first region 22. To facilitate mailing the folded statement in a window containing sending envelope, the printed customer address 32*b* on side 22*b* is generally facing in the opposite direction from or otherwise located 180° away from printed provider address 32*a* on side 22*a*. Printed account summary information 34 is preferably included on first side 24*a* of second region 24, and, if required, on the second or reverse side 24*b*. Printed information (not shown) indicating an amount due, customer account number, and billing due date are also preferably included on first region 22 of sheet 12.

Shorter sheets 14, 16, 18 may include various printed matter according to particular objectives by the provider or biller. For example, shorter sheets 14, 16, 18 may include additional account summary information if there is insufficient space on second region 24 of first sheet for the account summary information. Shorter sheets 14, 16, 18 may alternatively include printed advertising material, notices, flyers, and like printed subject matter.

The first or outer, longer page 12 of billing statement 10 may comprise, for example, an 8.5 by 14 sheet, while the remaining, inner pages 14, 16, 18 of the statement 10 comprise 8.5 by 11 sheets. First region 22 would may comprise a 3" by 8.5" portion which is detached along perforation 26 from second region 24 by a customer or billing recipient to leave the second region 24 as a conveniently sized 8.5 by 11 sheet of account summary information 34 which can be retained by the customer for record-keeping. The detached first region 22, together with a payment, would then be returned by mail, using return envelope 20, to the biller or provider or designated remittance processing center. The longer sheet 12 may alternatively be of a size other than 8.5" by 11", and may generally vary in size or shape according to particular applications of the present invention. A fold line 36 is shown on second region 24 of sheet 12, indicating the point of folding provided by the folder means, discussed below, for forming an approximately 8.5" by 5.5" folded billing packet suitable for envelope insertion.

The billing statement 10 as described above and shown in FIG. 1 through FIG. 3 is exemplary and may vary as to the size, shape, and arrangement of individual sheets, as well as the number of sheets of the billing statement 10. Preferably, the first or outer sheet 12, which will be viewed first by customers upon receiving mailed billing statement 10, includes important information such as the billing amount due, due date, and pertinent mailing addresses, as well as an account summary. Alternatively, it may be desirable to place one or more shorter sheets with an important printed notice thereon, such as an overdue notice, in the first or outer position of billing statement 10, in which case longer sheet 12 would not be the first or outermost sheet of the statement 10. A larger or smaller number of shorter sheets, having various information or materials printed thereon, may be included in billing statement 10 as required for individual applications of the present invention.

In another alternative arrangement of billing statement 10, first region 22 of sheet could comprise a separate, generally short sheet sized to fit within return envelope 20, while second region 24 comprises a separate is sheet located behind (or in front of) the short sheet. In yet another contemplated format for billing statement 10, which may be used in cases where a single provider provides billing for two or more services, there would be two or more generally longer sheets corresponding to sheet 12, with each longer sheet including a detachable portion to be remitted with a payment, and a portion retained for record keeping as described above. Such a billing statement format may additionally include two or more corresponding return envelopes, to allow separate payments for the two services by the customer. The two longer sheets could be adjacent and positioned as the first or outer sheets of the billing statement, or may be separated, with shorter sheets interspersed therebetween. Various additional billing statement formats in accordance with the invention, wherein one or more sheets of the statement are longer, shorter, wider, narrower, or otherwise of multiple lengths, widths and/or shapes will be suggested to persons of ordinary skill in the art.

Figure 4:
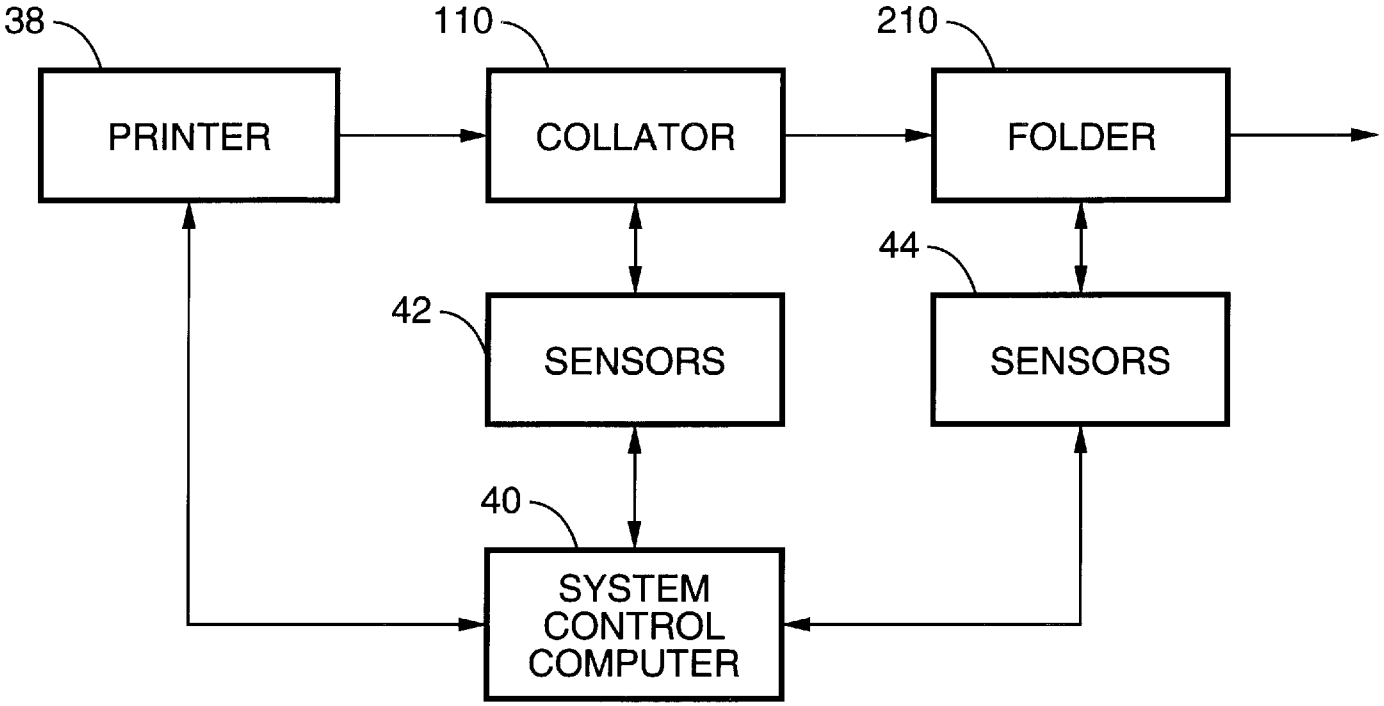
FIG. 4 is a diagrammatic representation of a billing statement system in accordance with the present invention.

Referring now to FIG. 4, means for processing a billing statement comprising multi-length sheets in accordance with the present invention are generally shown. Generally, a printer 38 outputs the individual printed sheets (not shown) of billing statements. Printer 38 may comprise, for example, a Xerox 4135 or 4635 printer system, a Delphax printer system, or other printer means which allows printing and separation of forms and sheets of multiple sizes or a continuous form printer with subsequently trimmed forms. Printed sheets (not shown) from printer 38 are transferred (usually sequentially) to collator means for collating the sheets of billing statements into collated billing packets. The collator means is preferably comprises a collator apparatus 110 wherein the individual printed sheets are registered along a leading edge, as discussed below in detail, and outputted as collated billing packets. The collated billing packets are then transferred to folder means for folding billing statements, which preferably comprises folder apparatus 210 wherein the billing packets are folded as described below. Folded billing packets may then directed from folder 210 to additional downstream processing operations (not shown) such as envelope insertion. Control means, preferably in the form of system controller computer 40, is interfaced with and directs operation of collator 110, and folder 210 according to input from sensors 42, 44, which detect and monitor the position or location of billing statements as they are processed by collator 110 and folder 210, as discussed below in detail. System controller computer 40 preferably is also interfaced with printer 38 and directs printing operations wherein printed images are provided on the sheets of the billing statements. Alternatively, separate control means may be used for directing operation of printer 38, collator 110, and folder 210.

Figure 5:
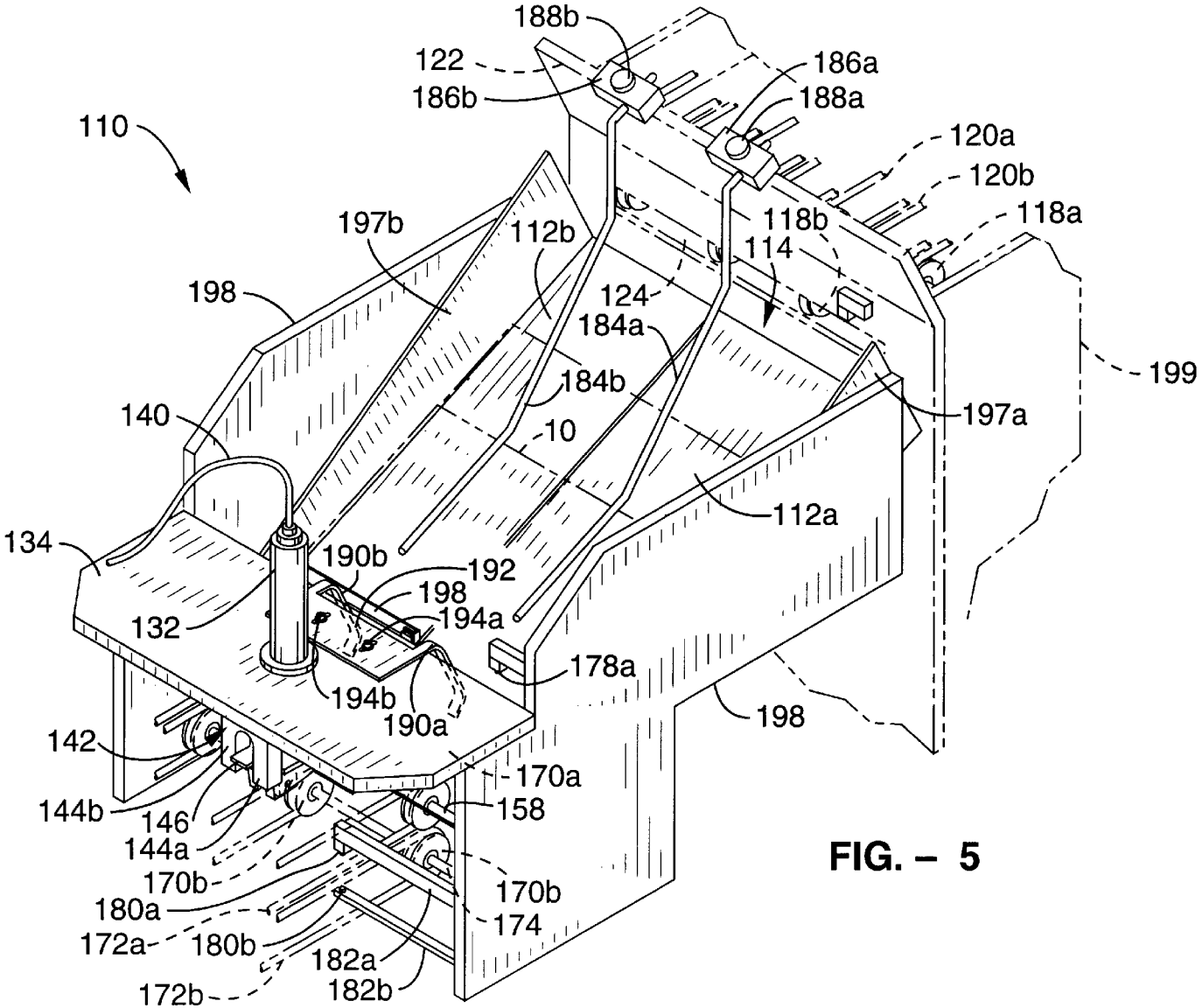
FIG. 5 is a perspective view of a collating apparatus in accordance with the present invention.
Figure 6:
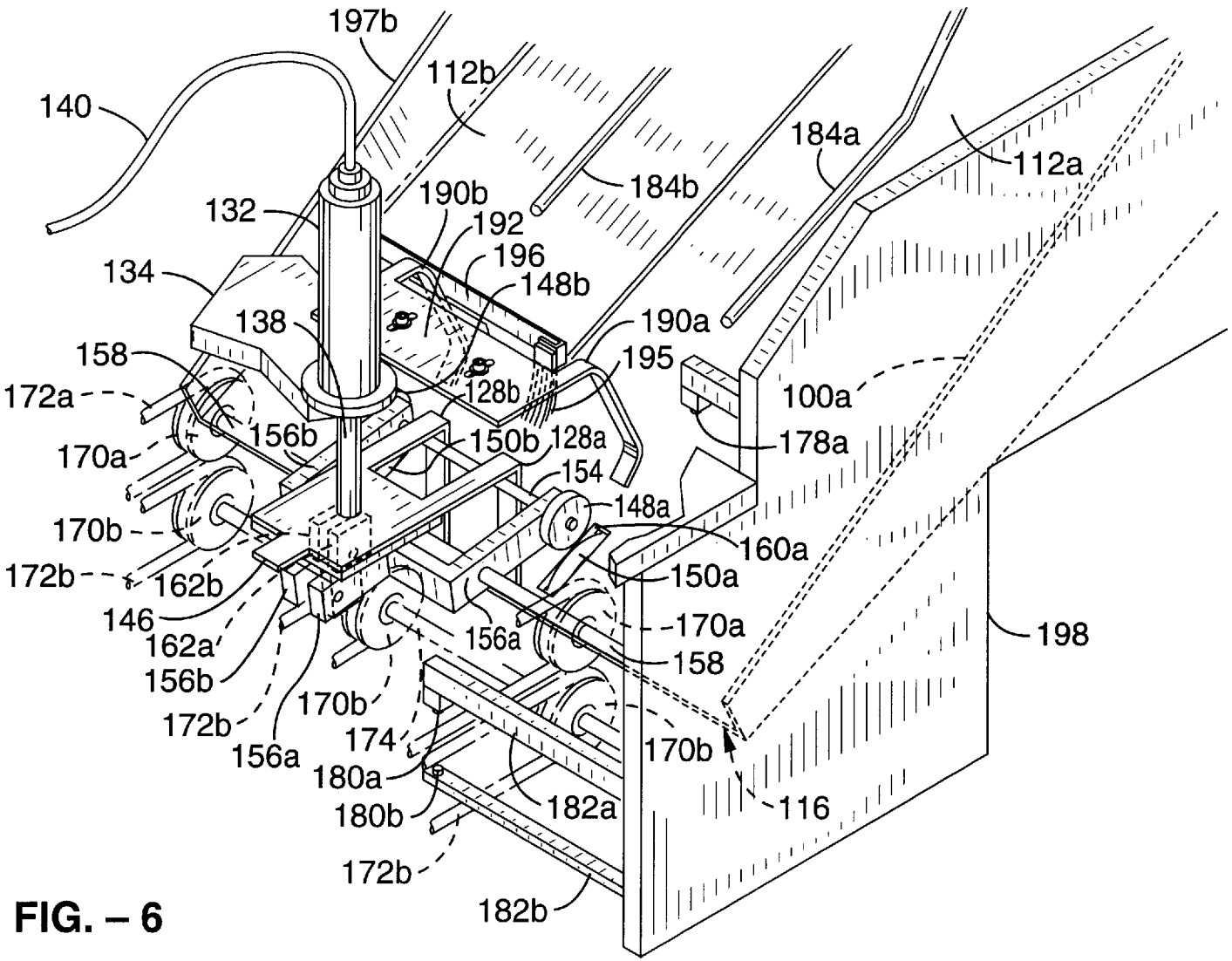
FIG. 6 is a perspective view of the pinch rollers, stopper, and actuator of the present invention.

Referring more specifically to FIG. 5 through FIG. 9, there is shown generally a preferred embodiment of collating apparatus 110 in accordance with the present invention which is suitable for collation of billing statements comprising sheets of multiple lengths and/or widths. The collating apparatus 110 includes a collating tray 112 of generally rectangular configuration to accommodate rectangular paper sheets or pages which comprise billing statements 10. Collating tray 112 preferably includes a first end 114 and a second end 116, with the first end 114 being positioned at a slightly higher position than the lower end 116 to provide gravity assistance in the collation operation, as described further below. Collating tray 112 is of generally rectangular configuration, and in the preferred embodiment collating tray 112 will generally have a width adequate for desired pages and in particular standard sized pages and sheets used in billing customers, i.e., about 8.5", international A-4, and the like. Collating tray 112 may include have a fixed width or have a width adjustment means for allowing quick and accurate collation of collections of sheets of various widths. A preferred width adjustment means comprises a split tray arrangement with tray halves or portions 112*a*, 112*b*, as shown in FIG. 5 and FIG. 6, which slidably translate relative to each other in a conventional manner with tray half 112*a* generally sliding over tray half 112*b*, allowing the width of collating tray 112 to be widened or narrowed as desired. The two halves of the collating tray 112*a* and 112*b* are fixed, relative to one another, by suitable locking means (not shown).

The collating tray 112 is of sufficient length between first and second ends 14, 16 so that pages or sheets of several lengths, such as 8.5' by 11", 8.5" by 14", 8.5" by 17", international A-4, and other lengths may be collated, to accommodate a variety of different billing statement formats. In the preferred embodiment of the collating means as shown in FIG. 5 through FIG. 9, sheets are registered and collated lengthwise or along the shorter edges of the sheets, as described further below. Collating tray 112, however, may alternatively be structured and configured in order to register and collate sheets by width or along the wider edges of the sheets to accommodate billing statements comprising sheets of multiple widths. Thus, the collator means of the present invention may be employed for collation of billing statement sheets of multiple widths as well as sheets of multiple lengths.

Input means for providing a plurality of sheets or pages to collating tray 112 are generally included with the collating means of the invention, with the input means mechanically interfaced with collating tray 112. The input means preferably comprises a conventional input transport system for paper sheets which includes upper pulleys 118*a* and lower pulleys 118*b*, and upper belts 120*a* and lower belts 120*b*. Upper and lower belts 120*a*, 120*b* form continuous, elongated loops which are associated with upper and lower pulleys 118*a* and 118*b* respectively at one end as well as a corresponding set of pulleys (not shown) at the other end of the elongated loops. Upper and lower pulleys 118*a*, 118*b* are positioned adjacent to each other and are spaced apart, usually vertically, at a suitable distance so that the paper sheets or forms of billing statements may be transported between upper and lower belts 120*a*, 120*b*, which frictionally engage the sheets. Upper and lower pulleys 118*a*, 118*b* and upper and lower belts 120*a*, 120*b* are rotationally driven by conventional means (not shown), and the action of the upper and lower belts 120*a*, 120*b* transports paper sheets forward for input into collating tray 112. Upper and lower belts 120*a*, 120*b* are generally made from an elastomeric material suitable for frictionally engaging paper sheets. A support member 122, which holds or supports upper and lower pulleys 118*a*, 118*b* of the input means in a conventional fashion, includes a slot 124 adjacent upper and lower pulleys 118*a*, 118*b* and first end 114 of collating tray 112. Sheets are directed from belts 120*a*, 120*b* and pulleys 118*a*, 118*b* into collating tray 112 through slot 124.

Other input means are also contemplated for use with the collator means of the present invention. For example, paper sheets may be directed into collating tray 112 through a chute or channel by means of suitably positioned compressed air jets and/or vacuum sources, or other mechanical input means commonly used in the art. Compressed air jets and/or vacuum sources may additionally be used in conjunction with the belt and pulley input transport system described above, if desired.

Figure 7:
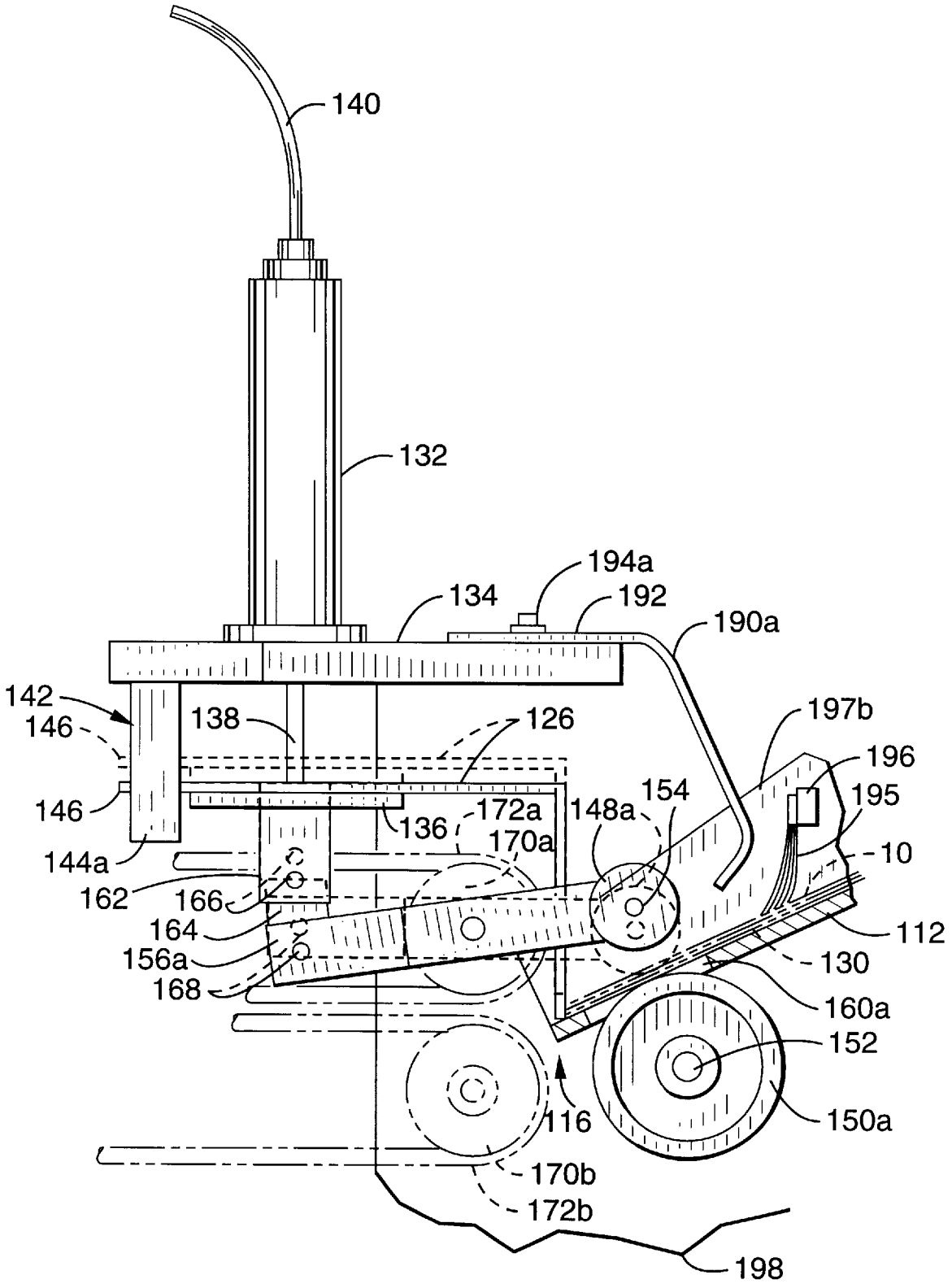
FIG. 7 is a side view of the pinch rollers, stopper, and actuator of the collating apparatus shown in FIG. 6.
Figure 8:
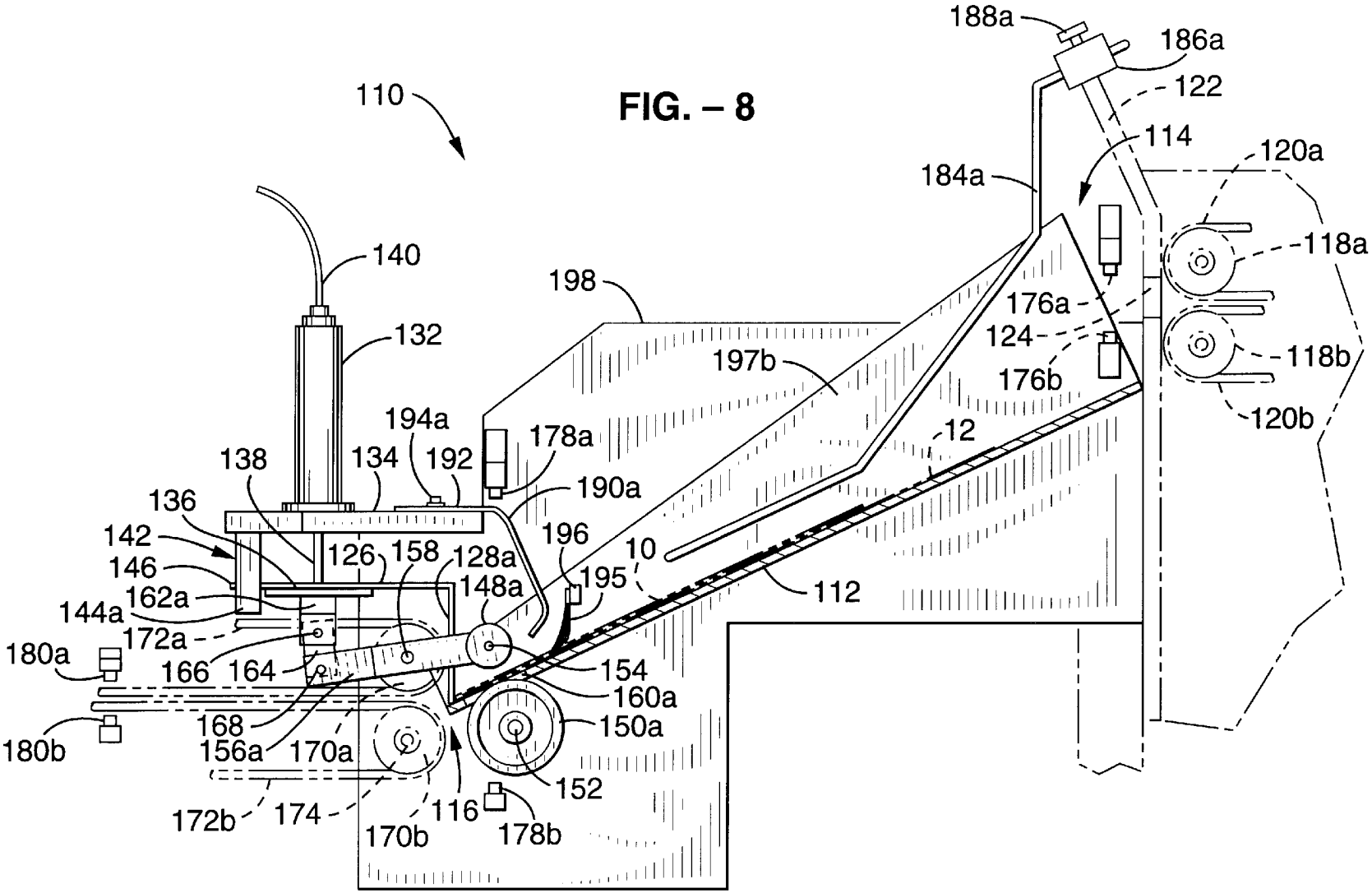
FIG. 8 is a side view of the collating apparatus of FIG. 5 showing a plurality of sheets in the collating tray registered against the stop bars.

The subject collator means also includes stopping means for registering a plurality of sheets within the collating tray 112. The stopping means preferably comprises a stopping member or stopper 126 which includes stop bars 128*a*, 128*b* (see FIG. 6) positioned adjacent the second end 116 of collating tray 112, against which a plurality of sheets register or align. Referring more particularly to FIGS. 7–8, a billing statement 10 comprising a plurality of multi-length sheets or pages is shown generally as aligned or registered against stopper 126 or stop bars 128*a*, 128*b* adjacent collating tray second end 116. Other stopping means may be employed with the collator means of the invention, if desired. For example, a block, plate, or any other stopping member structure which has a surface or other feature suitable for registering a plurality of sheets thereon may be substituted in place of stop bars 128*a*, 128*b* and stopper 126. As shown in FIG. 5 through FIG. 9, stop bars 128*a*, 128*b* are structured, configured, and positioned to register variously sized paper sheets and forms along the leading edge in an end-wise manner or along the shorter edge of the sheets, in order to facilitate collation of stacks of sheets which are of multiple lengths. However, stop bars 128*a*, 128*b*, as well as collating tray 112, may alternatively be structured and configured for collating of sheets along the longer edge or width-collating, as mentioned above.

Figure 9:
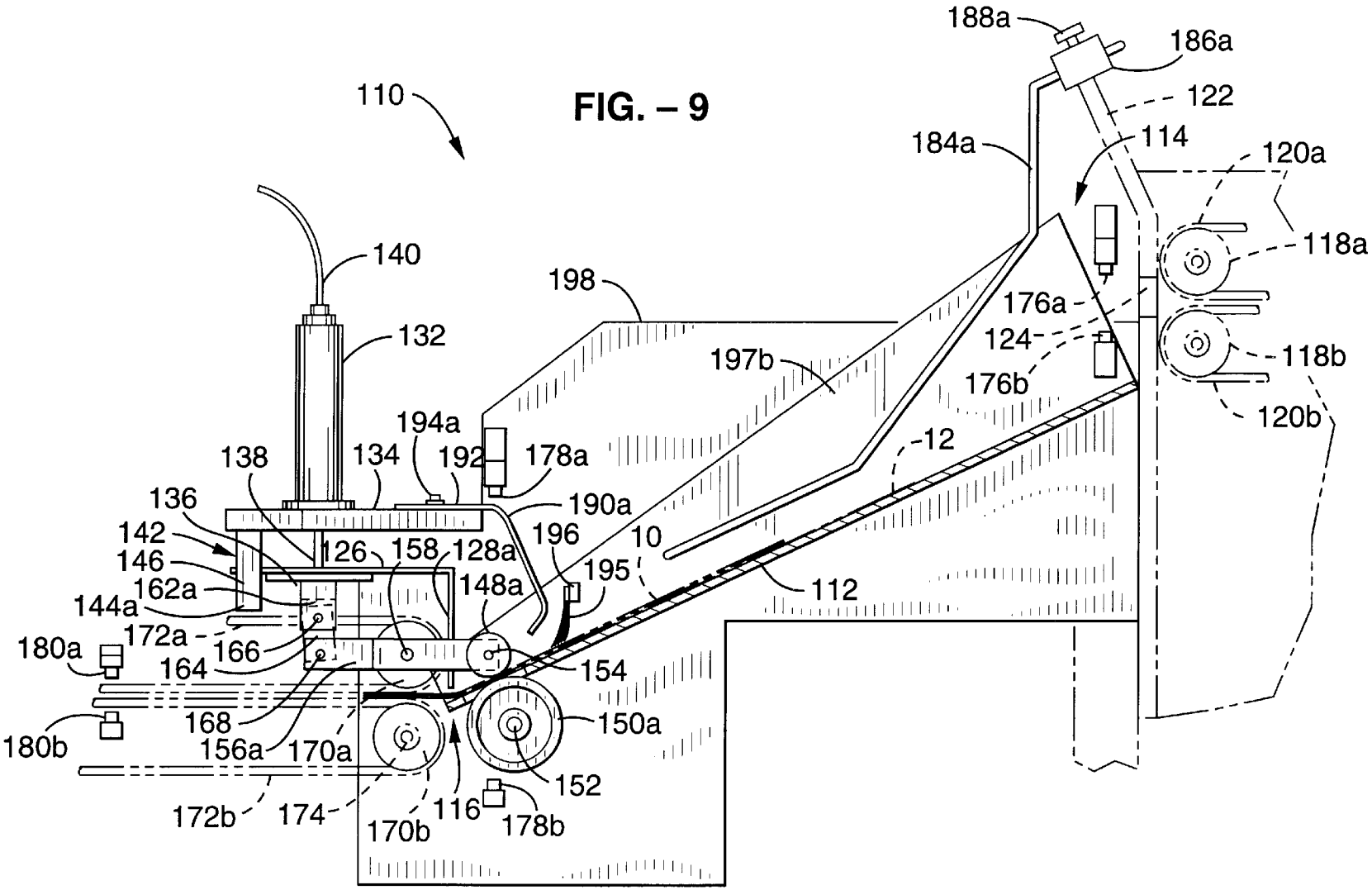
FIG. 9 is a side view of the collating apparatus of FIG. 5 showing a collated statement being removed from the collating tray by pinch rollers.

Referring particularly to FIG. 5 through FIG. 9, the stopper 126 and stop bars 128*a*, 128*b* comprising the stopping means of the collator 110 preferably move between two positions. In a first or sheet-registering position, shown in FIG. 7 and FIG. 8, stopper 126 and stop bars 128*a*, 128*b* are positioned so that the leading edge of each of the plurality of sheets of statement 10 registers against stop bars 128*a*, 128*b*. In a second or sheet-removing position shown in FIG. 9, stopping member 126 and stop bars 128*a*, 128*b* are positioned so that the collated statement 10 may be removed from collating tray 112 by suitable means as related below. In the presently preferred embodiment, the stopper 126 and stop bars 128*a*, 128*b* move in a generally vertical fashion (the exact orientation may vary from vertical to any other angle desired with corresponding changes to other positional references), with the "down" position for stopper 126 and stop bars 128*a*, 128*b*, wherein a plurality of sheets may register against stop bars 128*a*, 128*b*, and an "up" position wherein the collated sheets comprising billing statement 10 may be removed from collating tray 112. The subject collator means requires that only one edge (the leading edge) of each sheet registers against stop bars 128*a*, 128*b*. The trailing edges of the sheets do not need to be aligned or registered, thus allowing collation of sheets of multiple lengths. Note that while longer sheet 12 of billing statement 10 is seen in FIGS. 8 and 9 as the sheet on the bottom of the billing statement 10 and closest to the collating tray 112, other positions or locations of longer sheet 12 within billing statement are within the realm and scope of this disclosure, as related above.

The stopping means of collator 110 (see FIGS. 5–9) could alternatively be structured, configured, and positioned so that sheets register against the stopping means while in an "up" position, with the stopping means moving downward to a "down" position, by descending below collating tray 112, to allow removal of the collated sheets. Similarly, horizontal or other directional movement may also be employed with the stopping means instead of vertical movement as described above. For example, a horizontally moving gate or block may be employed as stopping means, with the gate sliding horizontally out of the way of the collated statement 10 to allow its removal from collating tray 112.

Means for actuating the stopping means are provided with collator 110, so that the stopping means may be moved between the aforementioned first, sheet-registering position and second, sheet-removing position. Preferably, the actuating means for the stopping means comprises a compressed air actuator 132, shown mounted on a support platform 134. Stopper 126 and its attached stop bars 128*a*, 128*b* are coupled to a base 136, which in turn is attached to plunger rod 138. Compressed air actuator 132 drives plunger rod 138 vertically, thereby moving stopper 126 and stop bars 128*a*, 128*b* vertically between the first or sheet-registering position and the second or sheet-removing position. Compressed air line 140 provides compressed air to actuator 132 from a compressed air source (not shown). Other actuating means may alternatively employed for moving stopper 126, such as an electric motor actuator, a vacuum actuator, a hydraulic actuator, or other actuators commonly used in the art. A vertical guide member 142, with downwardly disposed forks 144*a*, 144*b*, is coupled to platform 134. Stopper 126 preferably includes a tab 146 which slidably fits between forks 144*a*, 144*b*of guide member 142 (FIG. 5), thereby preventing undesirable lateral motion of stopper 126 and stop bars 128*a*, 128*b* during actuation.

Also included with collator 110 are means for removing the collated sheets from collating tray 112. Preferably, pinch roller means are employed for removing the collated billing statement or billing packet 10 from collating tray 112, preferably in the form of a plurality of upper pinch rollers 148*a*, 148*b*, and a plurality of lower pinch rollers 150*a*, 150*b*. Lower pinch rollers 150*a*, 150*b*, are rotationally mounted on horizontal rod 152, and are rotationally powered by suitable means (not shown). Upper pinch rollers 148*a*, 148*b*, are rotationally mounted by on rod 154, with rod 154 being coupled to pivot arms or brackets 156*a*, 156*b*. Pivot arms 156*a*, 156*b* are pivotally mounted on rod 158.

Removal of collated billing statement 10 is effected by bringing upper pinch rollers 148*a*, 148*b* and lower pinch rollers 150*a*, 150*b* together about collated billing statement or packet 10 and frictionally engaging statement 10, with the rotational motion of lower pinch rollers 150*a*, 150*b* serving to pull the statement 10 (from the front or leading edge) out of collating tray 112 and towards the output means, which is discussed further below. Upper and lower pinch rollers 148*a*, 148*b*, 150*a*, 150*b* are preferably brought together by pivoting arms 156*a*, 156*b*, which pivot about rod 158 so that upper pinch rollers 148*a*, 148*b* move downward until they come together with lower pinch rollers 150*a*, 150*b*. Collating tray 112 includes slots or channels 160*a*, 160*b* through which a portion of each lower pinch roller 150*a*, 150*b* protrudes. Upper and lower pinch rollers 148*a*, 148*b*, 150*a*, 150*b* preferably include an elastomeric surface (not shown) about their circumferences in order to facilitate frictional engagement with collated billing statement 10.

Upper pinch rollers 148*a*, 148*b*, are pivotally moved downward by suitable actuating means, which, in the preferred embodiment, is the same actuator 132 used for moving stopper 126 as described above. Preferably, actuation is provided for upper pinch rollers 148*a*, 148*b*, by means of a suitable linking mechanism that includes a pair of parallel, downwardly disposed vertical arms 162*a*, 162*b* which are coupled to base 136, with a joint member 164 fitting between vertical arms 162*a*, 162*b* and pivotally coupled thereto by pin 166. Joint member 164 is likewise interposed between arms 156*a*, 156*b* and pivotally coupled to arms 156*a*, 156*b* by pin 168. With this linking arrangement, when plunger rod 138 is vertically driven by actuator 132, vertical arms 162*a*, 162*b* and joint member 164 are actuated and thus arms 156*a*, 156*b* pivot about rod 158, and upper vertical rollers 148*a*, 148*b* accordingly move in a vertical fashion. Referring particularly to FIG. 6, FIG. 7, and FIG. 8, it can be seen that, when plunger rod 138 is moved downward and thus base 136 and stopper 126 are in a "down" or sheet registering position, upper pinch rollers 148*a*, 148*b* are pivotally moved via arms 156*a*, 156*b* into an "up" position away from statement 10 and lower pinch rollers 150, 150*b*. When plunger rod 138 is moved upward, thereby moving stopper 126 upward into the "up" or sheet-removing position, upper pinch rollers 148*a*, 148*b* are pivotally moved downward to engage the sheets of statement 10 between upper pinch rollers 148*a*, 148*b* and lower pinch rollers 150*a*, 150*b*. Thus, both the pinch rollers 148*a*, 148*b* and stopper 126 and stop bars 128*a*, 128*b*, are simultaneously actuated by actuator 132, with upper pinch rollers 148*a*, 148*b* coming together with lower pinch rollers 150*a*, 150*b* at generally the same time that stop bars 128*a*, 128*b* move out of the way of billing statement 10, thereby allowing removal of the collated statement 10 from collating tray 112.

While the means for removing the collated billing statement or packet 10 from collating tray 112 are generally described in this disclosure in terms of pinch roller means, it should be readily apparent to those of ordinary skill in the art that other means for removal of collated sheets from tray 112 are also suitable for use with the present invention. For example, clamp means may be used to grasp and remove collated statement 10 from tray 112. It is also contemplated that separate actuating means may be used with the invention for moving pinch rollers 148*a*, 148*b* together with lower pinch rollers 150*a*, 150*b*, rather employing the same actuator 132 as used for stopper 126 and stop bars 128*a*, 128*b*. The linking mechanism between plunger rod 138 and pivot arms 156*a*, 156*b* as described herein could alternatively be substituted with a standard universal joint.

The collated billing statement or packet 10, upon being removed from collating tray 112 by pinch rollers 148*a*, 148*b*, 150*a*, 150*b* as related above, is then directed towards output means for receiving collated statement 10 and directing the collated statement 10 elsewhere to other processing operations such as folding, discussed below. Preferably, the output means used with collator 110 comprises a conventional exit transport system which includes upper pulleys 170*a*, lower pulleys 170*b*, and upper belts 172*a* and lower belts 172*b*. As with the input transport system described above, belts upper and lower belts 172*a*, 172*b* form continuous, elongated loops which are associated with upper and lower pulleys 170*a* and 170*b* respectively at one end as well as a corresponding set of pulleys (not shown) at the other end. Upper and lower pulleys 170*a*, 170*b* are positioned adjacent to each other and are spaced apart vertically at a suitable distance so that standard paper sheets or forms may be transported between upper and lower belts 172*a* , 172*b* which frictionally engage the sheets. Upper and lower pulleys 170*a*, 170*b* and upper and lower belts 172*a*, 172*b* are driven by suitable means (not shown), and the action of upper and lower belts 172*a*, 172*b* transports collated billing statement 10 towards an exit gate (not shown) and other downstream processing operations. Upper and lower belts 172*a*, 172*b* are preferably made from an elastomeric material suitable for frictionally engaging paper sheets. Upper pulleys 170*a* are shown as rotationally mounted on rod 158, the same rod upon which arms 156*a*, 156*b* are pivotally mounted, in order to economize space and reduce the number of parts required for collator apparatus. However, upper pulleys 170*a* could alternatively be rotatably mounted on a rod or member other than rod 158, if desired. Lower pulleys 170*b* are rotationally mounted on rod 174.

The collating apparatus 110 generally operates at high speeds and handles collation of large numbers of billing statements which differ from each other in the number of pages or sheets, types of sheets, and the length of individual sheets within each billing statement. Thus, collator 110 preferably operates under computer control to accommodate high operating speeds and variable statement compositions. The control means 40, which is shown generally in FIG. 4 and is discussed further below under the general control scheme of FIG. 14, preferably comprises a computer controller which directions operation of actuator 132 and the input means of the collator 110. The control means monitors the position of statement 10 and individual sheets relative to collating tray 112 by sensing means. Generally, a plurality of suitably located sensors are used with the invention, and are interfaced to the control means. In the presently preferred embodiment, conventional photocells with a photoemitter and photodetector are employed. Preferably, a first sensor comprising a photoemitter and photodetector 176*a*, 176*b* is positioned adjacent first end 14 of collating tray 112 and adjacent to slot 124, for monitoring the input of individual sheets into tray 112 from the upper and lower pulleys 118*a*, 118*b* and upper and lower belts 120*a*, 120*b* of the input means. A second sensor comprising a photoemitter 178*a* and a photodetector 178*b* is positioned adjacent the second end 116 of collating tray 112 and stop bars 128*a*, 128*b* to monitor the presence or absence of sheets registered against stop bars 128*a*, 128*b*. Photoemitter 178*a* communicates with photodetector 178*b* through an aperture (not shown) in collating tray 112. A third sensor comprising a photoemitter 180*a* and a photodetector 180*b*, mounted on arms 182*a*, 182*b* (FIG. 5) respectively, is positioned adjacent to the output means to monitor the removal of collated billing packets or statements from collating tray 112 by the upper and lower pulleys 170*a*, 170*b* and upper and lower belts 172*a*, 172*b* of the output means.

To further facilitate high speed operation of the collating 110, guide means are generally employed to insure proper orientation of the sheets or pages of billing statement 10 in the collating tray 112. In the preferred embodiment, guide bars 184*a*, 184*b* are included, to direct sheets from the input means into collating tray 112 and in the general direction of stop bars 128*a*, 128*b*. Guide bars 184*a*, 184*b* are shown as mounted on support member 122 by clamps 186*a*, 186*b* and screws 188*a*, 188*b*. Other guide bar arrangements commonly used in the art may be employed with the subject invention. The guide means also preferably includes deflector bars 190*a* , 190*b* attached to plate 192 which is coupled to platform 134 by bolts 194*a*, 194*b*. Deflector bars 190*a*, 190*b* prevent sheets or pages from inadvertently sliding over upper pinch rollers 148*a*, 148*b*. Since the pages of statement 10 enter collating tray 112 at relatively high speeds, the leading edge of the sheets can bounce or recoil off of stop bars 128*a*, 128*b*, and interfere with subsequent sheets entering collating tray 112 from the input means. A brush 195, mounted on arm 196, provides a settling mechanism (necessary for high speed operations and material inconsistencies) to hold down or stabilize the sheets in billing statement 10, to serve as a paper check valve to prevent recoil or bouncing off of stop bars 128*a*, 128*b*, and to prevent improper interleaving of the sheets of statement 10. Other settling mechanisms, such as an elastomeric flap or compressed air/and or vacuum based systems may be employed with the invention as a settling mechanism. Compressed air and/or vacuum means may additionally be employed with collating tray 112 as shown in FIG. 5 through FIG. 9 to guide sheets to the proper location in tray 112 and to generally prevent mislocation of sheets and paper jams which would cause a system shutdown. First end 114 of collating tray 112 is preferably positioned higher than second end 116, to provide gravity assistance in directing sheets towards stop bars 128*a*, 128*b*. Tapered side walls 197*a*, 197*b* prevent unwanted lateral movement of sheets as they are directed across collating tray 112 towards stop bars 128*a*, 128*b*. The spacing or distance between side walls 197*a*, 197*b* may be varied by the width adjustment means discussed above, by slidably positioning tray halves 112*a*, 112*b* relative to each other. Collating apparatus 110 may be contained in housing 198 to protect the apparatus 110 and prevent inadvertent contact by persons with the sheets of statement 10 during the collating operation, which may result in injury to the persons and/or interruption of the collating operation. Likewise, a housing 199 may be provided to prevent contact with belts 120*a*, 120*b* and pulleys 118*a*, 118*b* of the input transport system, and a housing (not shown) can be included to protect the belts 172*a*, 172*b* and pulleys 170*a*, 170*b* of the exit transport system. Other equivalent arrangements of the sensors is considered to be within the domain of this disclosure.

Collator 110 as related above is described for exemplary purposes, and is merely one presently preferred embodiment of collating means suitable for use with billing statement format 10 as described above and illustrated generally in FIG. 1 through FIG. 3. Thus, the details of collator 110 should not be considered as limiting the scope of the billing statement system comprising the invention.

Figure 10:
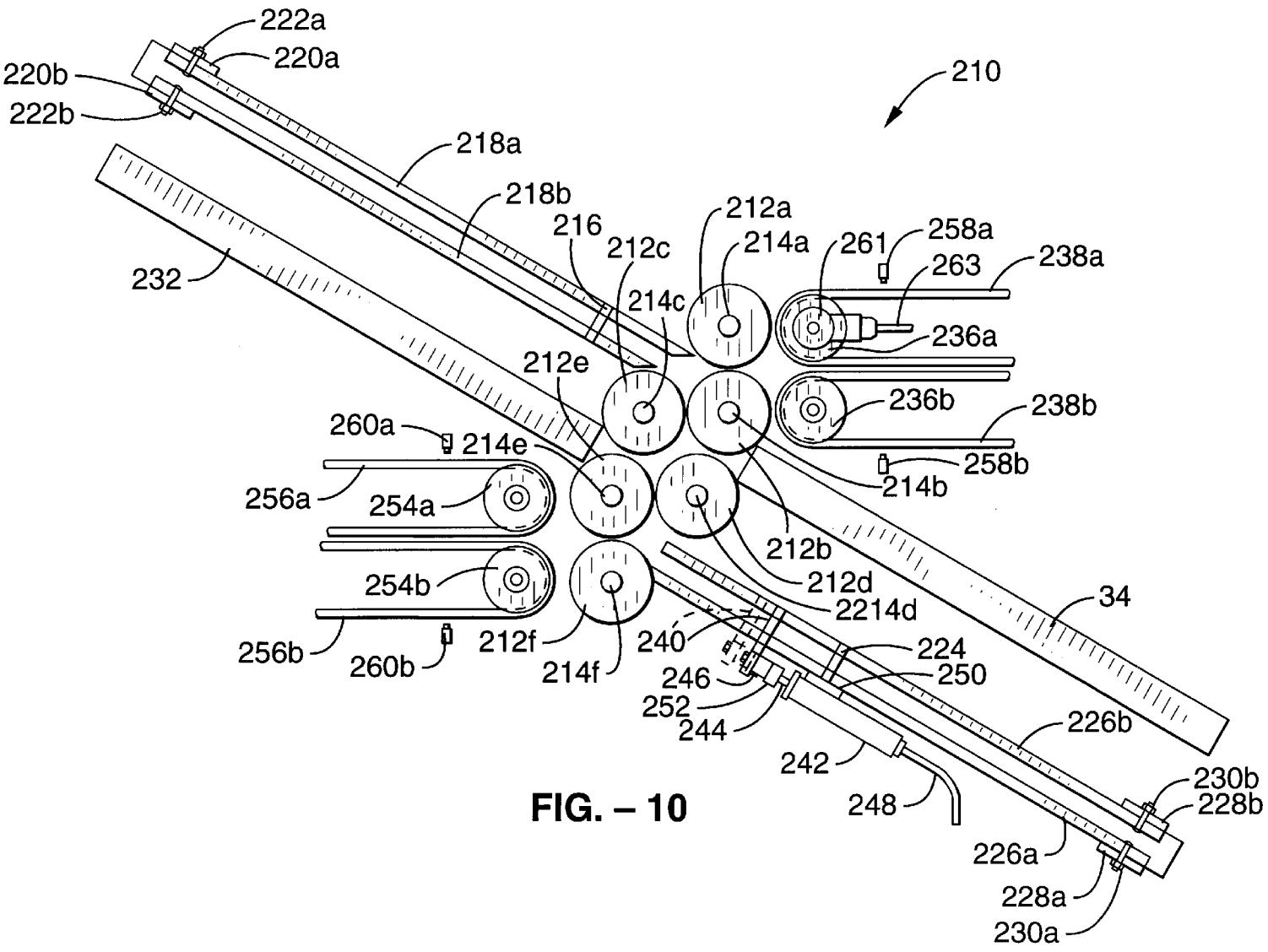
FIG. 10 is a side view of a folding apparatus in accordance with the present invention.
Figure 11:
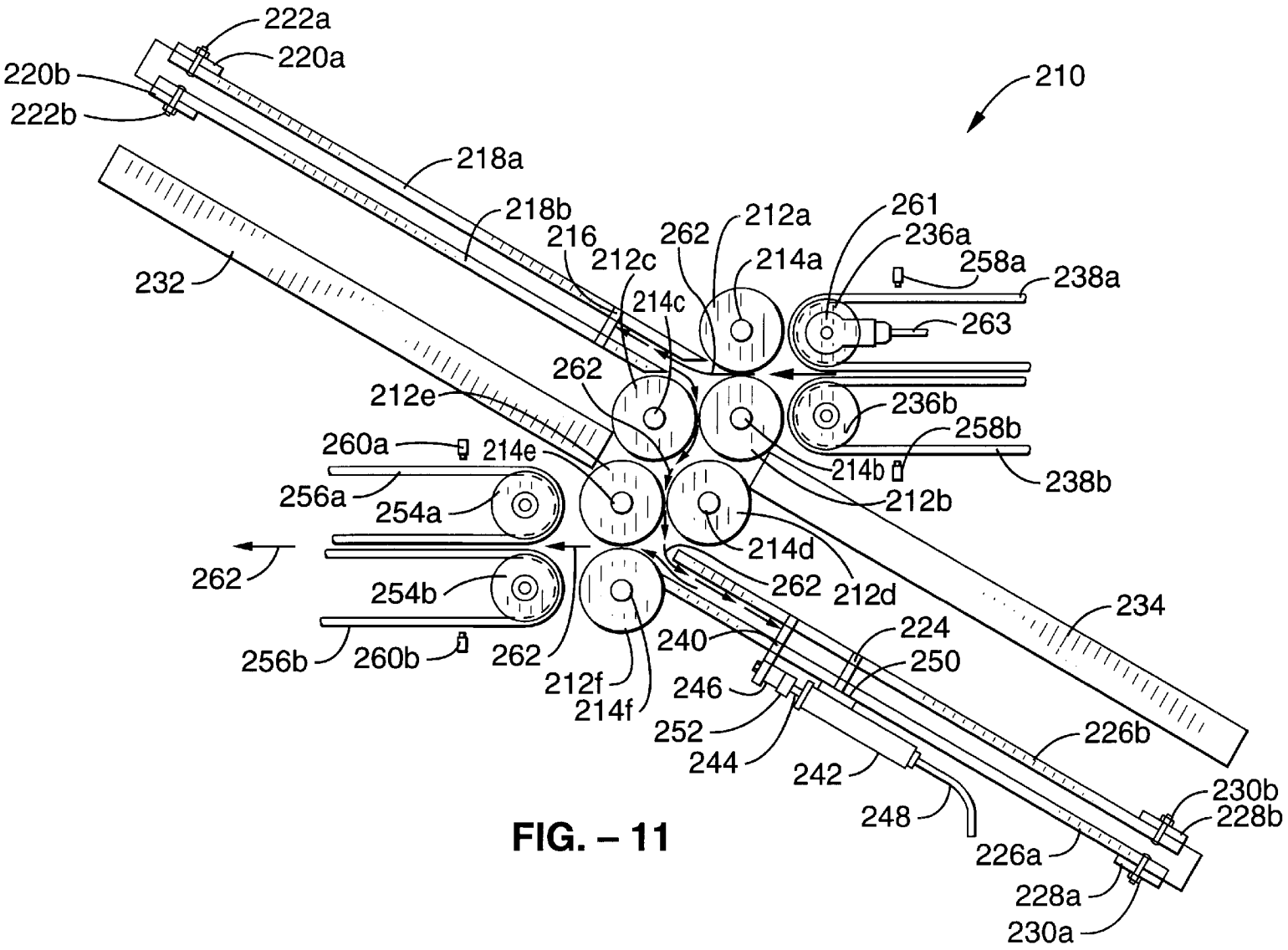
FIG. 11 is a side view of the folding apparatus of FIG. 10 showing a folding path.
Figure 12:
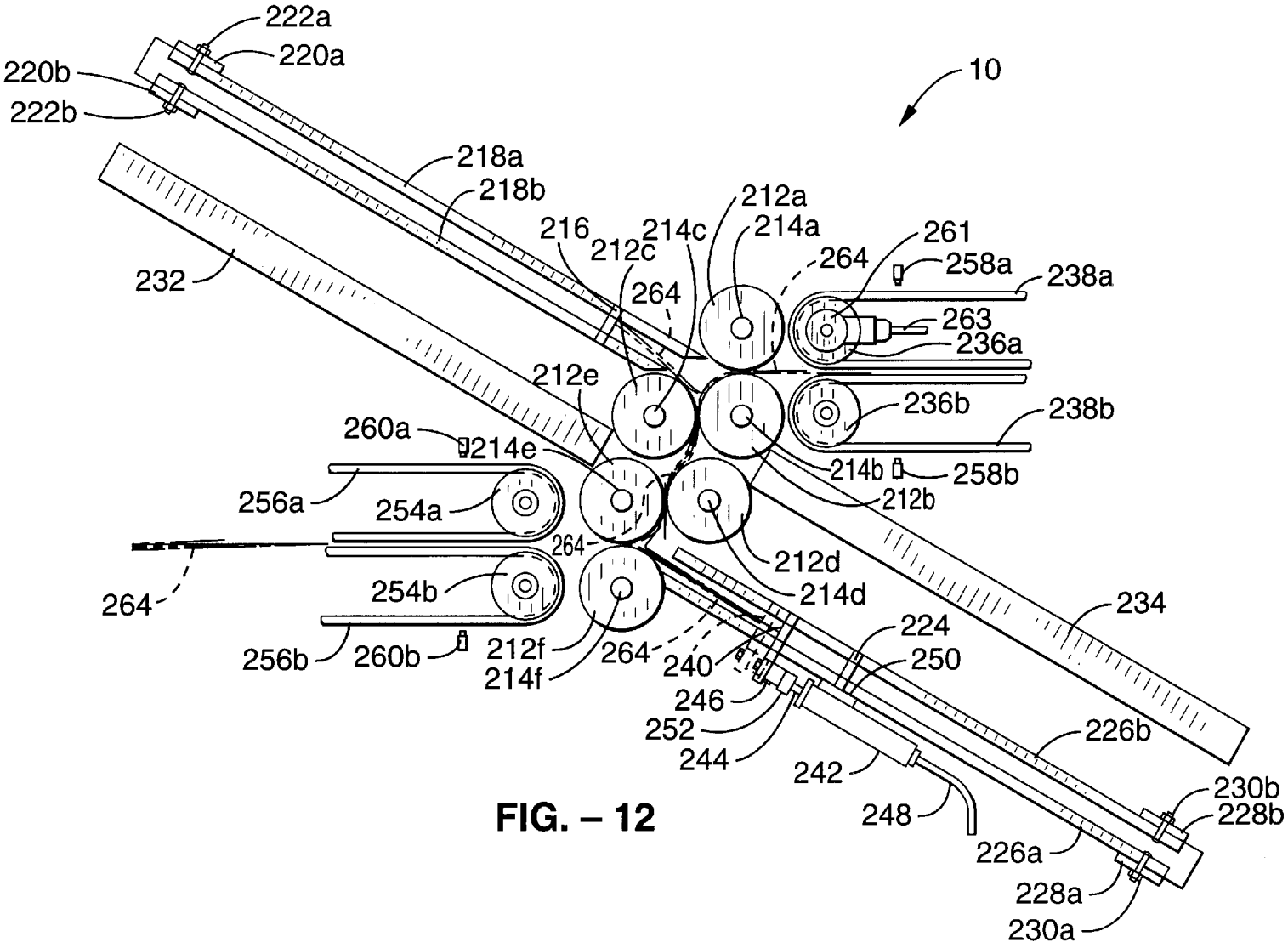
FIG. 12 is a side view of the folding apparatus of FIG. 10 illustrating generally the folding of a statement along a folding path.

Referring more specifically now to FIG. 10 through FIG. 13, for illustrative purposes the folder means of the present invention is embodied in the folding apparatus which is shown generally in FIG. 10 through FIG. 12, and the folding scheme shown in FIGS. 13A–13E. The folding means is described in terms of folding a billing statement which includes sheets of multiple lengths and/or widths, and preferably one longer sheet (usually an outer sheet, but the position may vary), together with one or more shorter sheets, as described above, with the billing statement being folded for insertion into convenient sized billing envelopes. However, as will be readily apparent to persons of ordinary skill in the art, a variety of folding operations, schemes, and formats, involving folding of various billing statement configurations having multiple sheets of varying lengths and widths and which are arranged in many ways, may be carried out with the folder means of the invention. Similarly, it should be readily understood that the folding apparatus may vary as to configuration and as to details without departing from the basic concepts disclosed herein.

Referring now to FIG. 10 through FIG. 12, there is shown generally a folding apparatus 210 in accordance with the folder means of the present invention, which quickly and efficiently folds billing statements containing pages or sheets of multiple lengths. The term statement as used in the following portion of the specification, refers generally to a plurality of paper sheets, forms, or pages which have been organized and collated into a collated billing packet in a manner suitable for folding and insertion into envelopes. The term packet generally refers to a billing statement which has undergone collating and/or folding by the collator and/or folder means of the invention.

The folding apparatus 210 includes a plurality of roller means for folding sheets, which, in the preferred embodiment, comprise conventional folder rollers 212*a*, 212*b*, 212*c*, 212*d*, 212*e*, and 212*f*. Folder rollers 212*a*–212*f*, which are shown in end view in FIG. 10 through FIG. 12, are generally elongated cylinders of suitable length for folding paper sheets, which typically have widths of 6 and ⅝, 8.5 or other widths as required for particular billing statements. Folder rollers 212*a*–212*f* have outer surfaces (not shown) with traction means for engaging paper sheets, as is standard in the art. Folder rollers 212*a*–212*f* are mounted on axles 214*a*–214*f* respectively, which are rotationally driven by conventional means. Standard adjustment means for positioning folder rollers 212*a*–212*f* are also generally included with the invention, and are omitted from the drawings for reasons of clarity.

The subject folder means also comprises one or more gate means for folding sheets. A first gate means is shown as a folder gate 216 mounted in a conventional folder gate assembly with frame members 218*a*, 218*b* and adjustment means for positioning folder gate 216, shown generally as gate adjustment knobs 220*a*, 220*b*, which are mounted by screws 222*a*, 222*b* to frame members 218*a* and 218*b* respectively. The adjustment means for positioning folder gate 216 also generally comprises belts (not shown) which connect knobs 220*a*, 220*b* with folder gate 216 so that rotation of knobs 220*a*, 220*b* causes folder gate 216 to translate along frame members 218*a* 218*b*. Other common adjustment means for positioning folder gate 216 may also be used with folder apparatus 210. A second gate means includes folder gate 224 which, like the first gate means, is mounted in a conventional gate assembly with frame members 226*a*, 226*b* and gate adjustment knobs 228*a*, 228*b* mounted respectively thereon by screws 230*a*, 230*b*. Additional gate means for folding sheets into various fold configurations may be included with folding apparatus 210, and are shown generally as gate assemblies 232, 234, which are identical to the first and second gate means as described above, and from which the details have been omitted for reasons of clarity. Means for ejecting folded sheets or statements out of a gate assembly and through a plurality of rollers are generally associated with one of the gate means, as is described further below.

Input means for providing sheets or pages to folder rollers 212*a*–212*f* are generally included with the folding apparatus 210, and preferably comprise a conventional document transport system for paper sheets which includes upper pulleys 236*a* and lower pulleys 236*b*, and upper belts 238*a* and lower belts 238*b*. Upper and lower belts 238*a*, 238*b* form continuous, elongated loops which are associated with upper and lower pulleys 236*a* and 236*b* respectively at one end as well as a corresponding set of pulleys (not shown) at the other end of the elongated loops. Upper and lower pulleys 236*a*, 236*b* are positioned adjacent to each other and are spaced apart vertically at an appropriate distance so that standard paper sheets may be transported between upper and lower belts 238*a*, 238*b*, which frictionally engage the sheets. Upper and lower pulleys 236*a*, 236*b* and upper and lower belts 238*a*, 238*b* are rotationally driven by standard means (not shown), and are positioned so that the action of the upper and lower belts 238*a*, 238*b* transports or inputs paper sheets into folder rollers 212*a*–212*f*. Upper and lower belts 238*a*, 238*b* are generally made from an elastomeric material suitable for frictionally engaging paper sheets. The input means of folding apparatus 210 is preferably interfaced with the output means of collator apparatus 110 as described above, so that collated billing statements or packets from collator 110 can be received directly by folder apparatus 210.

Other input means are also contemplated for use with folding apparatus 210. Billing statements may be directed into folder rollers 212*a*–212*f* through a chute or channel by means of compressed air jets and/or vacuum sources, or other mechanical input means commonly used in the art. Compressed air jets and/or vacuum sources may additionally be used in conjunction with the belt and pulley input transport system described above, if desired.

Also included with the folding apparatus 210 are means for ejecting or pushing folded sheets out of at least one gate means and through one or more folder rollers 212*a*–212*f*, in order to prevent undesired folding of the tips of the shorter sheets of a billing statement, as described above. In the preferred embodiment, the ejecting means comprises a kicker plate 240 which is slidably associated with the frame members 226*a*, 226*b* of the second gate means. Kicker plate 240 is moved or driven by suitable actuating means, which preferably comprise a compressed air actuator 242, which is coupled to kicker plate 240 by plunger rod 244 and connector member 246. Compressed air is supplied to actuator 242 via air line 248 which is connected to a compressed air source (not shown). Actuator 242 is attached to a base 250, with base 250 being mounted on frame member 226*a*. Actuator 242 and base 250 may alternatively be mounted directly onto gate 224. Actuator 242 may be driven by other means such as vacuum, electromagnetic force, and the like.

The ejecting means of the subject folder apparatus 210 may alternatively or in combination comprise a block, bar, forked member, or other structure suitable for ejecting folded billing statements. While kicker plate 240 is described and shown generally as associated with frame members 226*a*, 226*b* of the second gate means, this particular arrangement should not be considered limiting. Kicker plate 240 and actuator 242 could alternatively be associated with another gate means of the invention, or could be mounted on any suitable supporting structure wherein kicker plate 240 is positioned to push folded sheets through certain ones of the plurality of folder rollers 212*a*–212*f* as required to prevent unwanted folding of the tips of shorter sheets in a billing statement. Mounting the kicker plate 240 or other ejecting means directly onto the frame members of one of the gate means in the manner shown facilitates the construction and operation of the invention, and thus is the presently preferred arrangement. Kicker plate 240 is shown associated with frame members 226*a*, 226*b* of the second gate means in order to illustrate the use of the preferred folder means of the present invention with the particular folding operation shown in FIGS. 13A–13E and described below. The location of kicker plate 240 or other ejecting means may thus be varied relative to folder rollers 212*a*–212*f*, depending upon the particular folding operation which is to be carried out with the billing statement of the invention.

Means for positionally adjusting kicker plate 240 are generally provided, to allow control of the amount or level of pushing or ejection provided by kicker plate 240 to a folded billing statement. A translational adjuster 252, associated with connector member 246, may be used to provide accurate positioning of kicker plate 240. Base 250 could also include sliding adjustment means for positioning actuator 242 and kicker plate 240. If base 250 is mounted directly onto gate 224, the position of kicker plate 240 and actuator 242 may be adjusted by the positioning of gate 224 by turning adjustment knobs 228*a*, 228*b*, as described above. Other adjustment means commonly used in the art may also be used for positionally adjusting kicker plate 240.

Folded billing statements or billing packets are removed from folder rollers 212*a*–212*f* by output means which preferably comprise a conventional document transport system with upper pulleys 254*a*, lower pulleys 254*b*, and upper belts 256*a* and lower belts 256*b*. As with the input transport system described above, upper and lower belts 256*a*, 256*b* form continuous, elongated loops which are associated with upper and lower pulleys 254*a* and 254*b* respectively at one end as well as a corresponding set of pulleys (not shown) at the other end. Upper and lower belts 256*a*, 256*b* frictionally engage the folded sheets or statements received from folder rollers 212*a*–212*f*, and transport them to other downstream processing operations, such as insertion of the folded billing statements or packets into envelopes.

Figure 14:
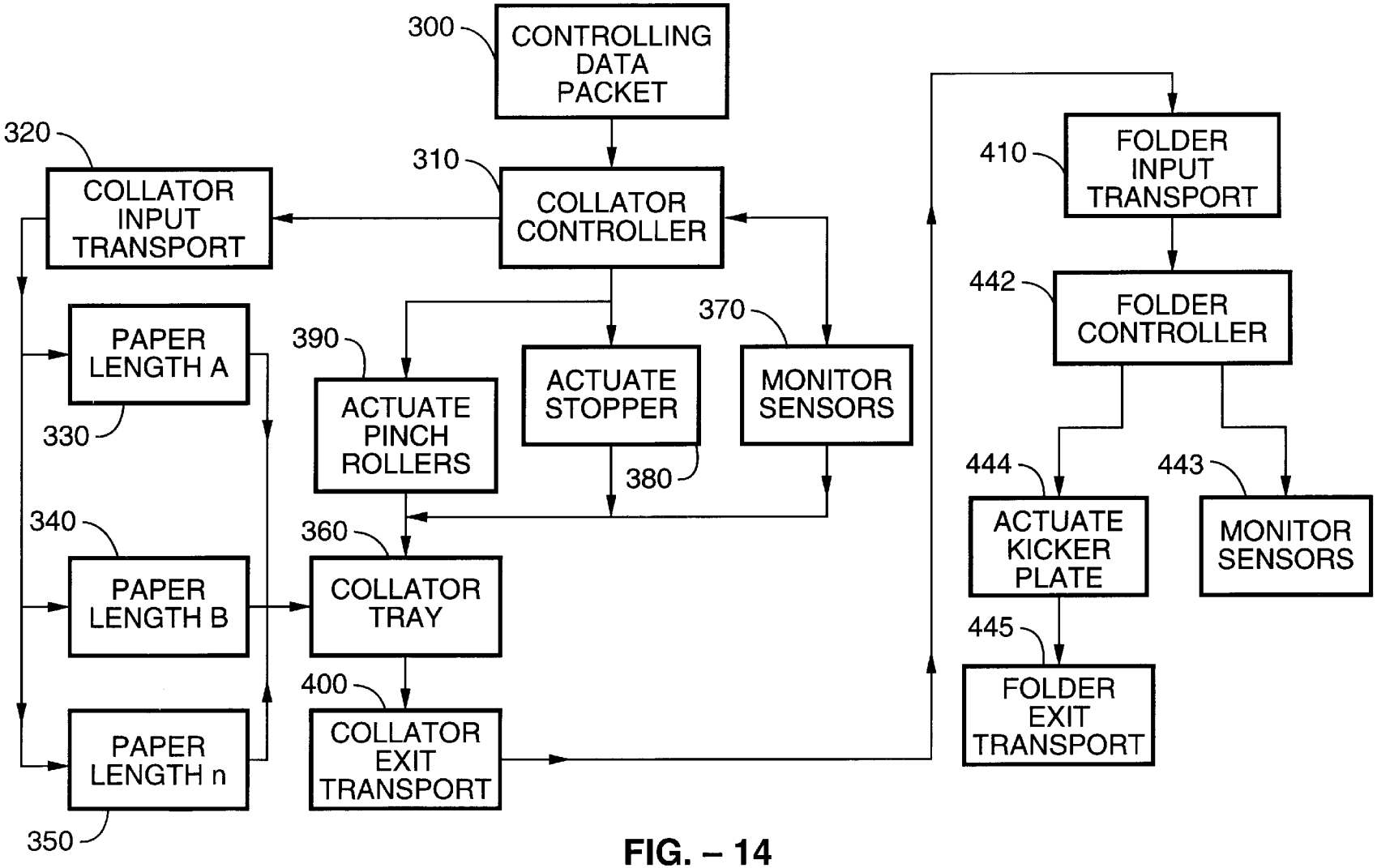
FIG. 14 is a flow diagram indicating a general control scheme for the billing statement system comprising the present invention.

The folding apparatus 210 generally operates under the direction of computer control means, which is preferably a system controller computer as shown in FIG. 4 and discussed further below in reference to FIG. 14. Preferably, sensor means, which are interfaced with the control means, detect the position or location of sheets before and after folding relative to the folder rollers 212*a*–212*f*, folder gate 216, and kicker plate 240. The sensor means preferably comprising encoder means such as a rotational shaft encoder 261, shown associated with pulley 236*a*, is included to provide timing information to the control means based on rotational values. Interface cable 263 connects encoder 261 with the control means. Generally pulleys 236*a*, 236*b* of the input means, pulleys 254*a*, 254*b* of the output means, and folder rollers 212–212*f* are driven by the same power source, such as an electric motor (not shown), and the monitoring by encoder 261 of the rotational angle of pulley 236*a* provides information for the overall machine cycle of the folding apparatus 210. Monitoring of the machine cycle of the folding apparatus 210 in this manner allows the controller means to activate kicker plate 240 at the correct time. Encoder 261 may alternatively be located on one or more of the folder rollers 212*a*–212*f*, or on one of the other pulleys 236*b*, 254*a*, 254*b* of the input or output means. The encoder means may also be included within the motor (not shown) that drives the folding apparatus 210, with the motor suitable interfaced with the control means.

The sensor means also preferably comprises a first photoemitter and photodetector 258*a*, 258*b* positioned generally adjacent to the input means of the invention, and a second photoemitter and photodetector 260*a*, 260*b* positioned generally adjacent to the output means of the invention. The folding apparatus 210, however, may be operated without such sensing means.

Referring now to FIG. 13A through FIG. 13E as well as FIG. 11 and FIG. 12, the use of folding apparatus 210 for folding a billing statement or packet with one long sheet and one shorter sheet is generally illustrated. As stated above, the invention may be used for a variety of folding operations of billing statements comprising various collections of sheets or pages of multiple widths and lengths. Thus, the example described herein and shown generally in FIGS. 13A through 13E is merely for illustrative purposes.

Referring first to FIG. 11, there is shown a folding path 262 in accordance with the illustrative example mentioned above. Folding path 262 is obtained by adjusting the positions of folder rollers 212*a*–212*f*, folder gate 216 and kicker plate 240 generally to the positions shown in FIG. 11 and FIG. 12. Different positioning of the folder rollers 212*a*–212*f* and the folder gate is means may be used for different folding operations and/or different billing statement formats.

Referring more particularly to FIG. 13A through FIG. 13E, there is shown a billing statement or packet 264 (essentially, the 264 billing statement or packet is the same billing statement or packet as number 10 earlier presented, however, in order to present and stress all of the various folding configurations, a new number has been assigned) undergoing folding according to configuration of folder rollers and folder gates shown in FIG. 11 and FIG. 12. In FIG. 13A, billing statement or packet 264 is shown to include a longer sheet 264*a* and a shorter sheet 264*b*. Statement 264 is provided to the folder rollers 212*a*–212*f* by the belts 238*a*, 238*b* and pulleys 236*a*, 236*b* of the input means, with sheets 264*a*, 264*b* registered or aligned at the front or leading edge 266 of statement 264. The registration or alignment of sheets 264*a*, 264*b* is generally achieved through use of collator means such as collator apparatus 110 described above, which provides statement 264 to the input means of folder apparatus 210 as a collated billing packet. Statement or packet 264 is directed by the input means to a first pair of folder rollers 212*a*, 212*b*, which grab statement 264 and direct it towards folder gate 216. When front edge 266 of statement 264 comes into contact with folder gate 216, a buckle 268 is formed in the statement 264 by the action of rollers 212*a*, 212*b*, and statement 264 is directed through rollers 212*b*, 212*c* wherein statement 264 undergoes folding.

As billing statement or packet 264 passes between rollers 212*b* and 212*c*, it is folded generally in half, as shown in FIG. 24B, so that statement 264 has a folded leading edge 270 and a protruding tail 272 due to the longer sheet 264*a* (FIG. 13A). Statement 264 is passed along folder path 262 by folder rollers 212*b*, 212*c*, through rollers 212*d*, 212*e*, and towards kicker plate 240, which is mounted on frame members 226*a*, 226*b* of the gate assembly of the second gate means. When the leading, folded edge 270 comes into contact with kicker plate 240, further travel in that direction is prevented. The statement 264 will stay in this position until kicker plate 240 is actuated, ejecting or pushing the statement 264 into rollers 212*e*, 212*f*. Folder rollers 212*b*, 212*c* and 212*d*, which passively engage statement 264 along folding path 262, prevent statement 264 from being forced back up into those folder rollers.

Kicker plate 240 is actuated by actuator 242 under the direction of the control means and according to the monitoring of the position of statement by the sensor means, as discussed below. Kicker plate 240 moves in a direction generally parallel to frame members 226*a*, 226*b*, and the range of the motion of kicker plate is shown in dashed lines in FIG. 12 as well as FIG. 10. The action of kicker plate 240 pushes folded edge 270, which is now the trailing edge, and thereby ejects statement 264 through folder rollers 212*e*, 212*f*. During this process the protruding tail 272 is folded over, preferably along a perforation (not shown), and then creased by folder rollers 212*e*, 212*f* to provide a folded billing statement or packet 264 as shown generally in FIG. 13D.

After ejection by kicker gate 240 and passing through folder rollers 212*e*, 212*f*, statement 264 is folded as shown in FIG. 13E, with tail 272 generally parallel to the remainder of statement 264, to provide a folded configuration for statement 264 suitable for insertion into an envelope.

As related above, FIG. 11, FIG. 12, and FIG. 13A through FIG. 13E illustrate one of many possible folding operations which may be carried out with the billing statement system of the present invention. The aforementioned folding operation is shown with sheets 264*a*, 264*b* (FIG. 13A) traveling along folding path 262 (FIG. 12) in a lengthwise manner, with shorter edges of sheets 264*a*, 264*b* serving as leading edges upon entering rollers 212*a*, 212*b*. However, in other possible folding schemes and billing statement formats, the wider edges of sheets 264*a*, 264*b* could be the leading edges upon entering folder rollers 212*a*, 212*b*. In a further possible folding scheme which may be carried out with the folding apparatus 210, billing statement 264 could, for example, be folded into thirds prior to the folding of tail 270, rather than in half as shown in FIG. 12 and FIG. 13A through FIG. 13E, by appropriate positioning of the folder rollers 212*a*–212*f*, kicker plate 240, and the gate means of folding apparatus 210. While the gate means 232, 234 shown in FIG. 10 through 12 are not used in the folding operation depicted in FIG. 12 and FIG. 13A through FIG. 13E, gate means 232, 234 may be used in other folding operations. Likewise, kicker gate 240, while shown as associated with frame members 226*a*, 226*b* of the second gate means, may alternatively be included with the second or third gate means 232, 234.

Referring now to FIGS. 14A and 14B, there is shown a flow diagram indicating the general control scheme for the billing statement system comprising the present invention. In referring to FIG. 14A and FIG. 14B, the method of using the present invention will be described generally in the context of a large scale billing operation wherein a large number of billing statements are prepared for mailing to customers.

Generally, data storage means containing a database for the billing is employed with the billing statement system of the invention, and the individual accounting and address information for each client or mail recipient to whom the billing statements will ultimately be mailed is stored in the data base. Other steps in the billing statement processing operation, such as the printing, separation, and organization (not shown) of the individual sheets for each statements, are generally carried out by conventional means according the information in the data base prior to the collating and folding operations carried out by the subject billing statement system.

The database or data storage means includes a controlling data packet 300 which contains all of the information necessary for collating and folding the pages or sheets of the billing statements for a billing job or operation, including the number of pages, the types of pages and forms for each billing statement, and the order of the pages and forms within each billing statement.

A collator controller 210, which preferably comprises a computer or other control means, is interfaced with the database and in communication therewith, and receives information from the controlling data packet 300 contained therein. The database and controlling data packet 300 may physically be internal to collator controller 210, or external and linked thereto by suitable interface means.

A captive collator input transport 320 is controlled by collator controller 310. Collator input transport 320 provides or otherwise directs the sheets and forms of the billing statements for collation and folding in the order required, according the information in controlling data packet 300. Collator input transport 320 is preferably a belt and pulley input transport system as described above, and is interfaced with a document preparation system (not shown) such as a Xerox 4635 printer which allows printing of forms and sheets of multiple sizes which are then separated, organized, and provided to the collator input transport 320 by standard means.

Each individual billing statement generally includes a plurality of pages or sheets of multiple lengths or sizes, which are shown in FIG. 14A as paper length A, 330, paper length B, 340, and additional paper lengths on up to paper length n, 350, depending on the type of billing statement or statements being prepared by the subject billing statement system. Sheets of paper length A, paper length B, and paper length n (330, 340, and 350, respectively) are directed by the collator input transport 320, at the instruction of collator controller 310 and according to the controlling data packet 300, to collator tray 360.

Collator tray 360 is mechanically interfaced to collator input transport 320 in the manner described above, and preferably includes a stopper, a pinch rollers, and a plurality of sensors interfaced with collator controller 310 as related above. Sheets of paper lengths A, B, and n (330, 340, and 350, respectively) are received by collator tray 360 from the collator input transport 320 as directed by collator controller 310, and are registered against the stopper.

Collator controller 310 monitors sensors 370 to detect the presence and location of sheets of paper lengths A, B, and n (330, 340, and 350, respectively) and the presence or absence of a billing statement against the stopper, as described above. When the monitoring of sensors 370 indicates to collator controller 310 that a complete billing statement is collated and ready for removal from collator tray 360, collator controller 310 actuates stopper 380 and actuates pinch rollers 390 so that the pinch rollers grab or pull the collated statement from the front or leading edge and remove the statement from collator tray 360 and direct the statement to a semi-passive collator exit transport 400. Collator exit transport 400 is preferably a belt and pulley type exit transport system as described above. Collator exit transport 400 outputs collated billing packets or statements.

From collator exit transport 400, the collated billing statements are directed to folder input transport 410 (FIG. 14B) for folding of collated statements received from exit transport 400. Collator exit transport 410 and folder input transport are mechanically interfaced or contiguous to each other so that outputted collated billing packets or statements are delivered to the folder means of the invention. Folder input transport 410 preferably comprises a conventional document transporting system as described above.

Folder controller 420, which may be the same control means as collator controller 310, directs the folding operation, as described above, to avoid unwanted folding of the tips of the shorter sheets of the billing statements. Sensor means are preferably interfaced with folder controller 420 to allow detection and monitoring of the location of billing statements during the folding operation. Folder controller 420 monitors sensors 430 by tracking the rotation of a shaft encoder and/or photocell sensors as described above. Folder controller 420 actuates kicker plate 440 at the correct time according to sensor monitoring 430, to avoid unwanted folding of the tips of the shorter sheets of the billing statements as described above. Actuation of kicker plate 440 by folder controller 420 ejects folded billing statements from the rollers of the folder means as described above.

Folder exit transport 450, which is preferably a belt and pulley-type document transportation system, receives folded billing statements from folder rollers of the folding means, and outputs folded billing packets or statements. Monitoring sensors 430 by folder controller 420 provides verification that folded statements have entered the folder exit transport 450. Folder exit transport 140 may be interfaced with another billing statement processing apparatus (not shown), such as an envelope insertion system.

Accordingly, it will be seen that the present invention discloses a billing statement system which provides billing statements each having a plurality of sheets of multiple lengths or otherwise varying in size and/or shape, and which provides for the collating and folding of the billing statements. Although the above description contains many specificities, these should not be construed as limiting the scope of the invention, but as merely providing illustrations of some of the presently preferred embodiments. Thus, the scope of the invention should be determined by the appended claims, and their legal equivalents.

What is claimed is:

1. A billing statement system, comprising:

(a) a billing statement, said billing statement including at least one first sheet and one or more second sheets, wherein said first sheet has a size different from said second sheet or sheets; and (b) collator means for collating said billing statement into a billing packet, wherein said collator means comprises:

i) a collating tray;

ii) stopping means for registering at least one said first sheet and optionally one or more said second sheets of said billing statement in said collating tray, thereby collating said first sheet with any said optional second sheets; and iii) means for removing said collated sheet or sheets of said billing statement from said collating tray, wherein said removing means comprises a plurality of pinch rollers, said pinch rollers including a plurality of upper pinch rollers and a plurality of lower pinch rollers, said upper pinch rollers positioned adjacent said lower pinch rollers, said actuating means bringing said upper pinch rollers and said lower pinch rollers together.

2. A billing statement system, comprising:

(a) a billing statement, said billing statement including at least one first sheet and one or more second sheets, wherein said first sheet has a size different from said second sheet or sheets; and (b) collator means for collating said billing statement into a billing packet, wherein said collator means comprises:

i) a collating tray;

ii) stopping means for registering at least one said first sheet and optionally one or more said second sheets of said billing statement in said collating tray, thereby collating said first sheet with any said optional second sheets, wherein said stopping means is actuated between a first, sheet-registering position and a second, sheet-removing position; and iii) means for removing said collated sheet or sheets of said billing statement from said collating tray.

3. A billing statement system, comprising:

(a) a billing statement, said billing statement including at least one first sheet and one or more second sheets, wherein said first sheet has a size different from said second sheet or sheets; and (b) folder means for folding said billing statement, wherein said folder means comprises:

i) a plurality of roller means for folding said first and said optional second sheets;

ii) at least one gate means for folding said first and said optional second sheets, said gate means adjacent to said plurality of roller means; and iii) means for ejecting folded billing statements through said roller means.

4. A billing statement system according to claim 3, wherein said folder means further comprises control means for directing said ejecting means.

5. A billing statement system according to claim 4, wherein said folder means further comprises sensor means for tracking the location of said first and said second sheet or sheets relative to said ejecting means, said sensor means interfaced with said control means.

6. A billing statement system according to claim 3, wherein said folder means further comprises input means for providing said first and said second sheet or sheets of said billing statement to said plurality of roller means, and output means for removing folded billing statements from said roller means.

7. A billing statement system, comprising:

(a) a billing statement, said billing statement including at least one first sheet and one or more second sheets, wherein said first sheet has a size different from said second sheet or sheets;

(b) collator means for collating said billing statement into a billing packet, wherein said collator means comprises:

i) a collating tray;

ii) stopping means for registering at least one said first sheet and optionally one or more said second sheets of said billing statement in said collating tray, thereby collating said sheets;

iii) means for removing said collated sheet or sheets of said billing statement from said collating tray as a collated billing packet, wherein said removing means comprises a plurality of pinch rollers, said pinch rollers including a plurality of upper pinch rollers and a plurality of lower pinch rollers, said upper pinch rollers positioned adjacent said lower pinch rollers, said actuating means bringing said upper pinch rollers and said lower pinch rollers together; and iv) means for actuating said stopping means and means for actuating said removing means;

(c) folder means for folding said billing packet; and (d) control means for directing operation of said collator means and said folder means.

8. A billing statement system, comprising:

(a) a billing statement, said billing statement including at least one first sheet and optionally one or more second sheets, wherein said first sheet has a size different from said optional second sheets;

(b) collator means for collating said billing statement into a billing packet, wherein said collator means comprises:

i) a collating tray;

ii) stopping means for registering at least one said first sheet and optionally one or more said second sheets of said billing statement in said collating tray, thereby collating said sheets; and iii) means for removing said collated sheet or sheets of said billing statement from said collating tray as a collated billing packet;

(c) folder means for folding said billing packet, wherein said folder means comprises:

i) a plurality of roller means for folding said billing packet;

ii) at least one gate means for folding said billing packet, said gate means adjacent to said plurality of roller means; and iii) means for ejecting folded billing packets through said roller means; and (d) control means for directing operation of said collator means and said folder means.

9. A billing statement system according to claim 8, wherein said control means is interfaced with said ejecting means.

10. A billing statement system according to claim 9 wherein said folder means further comprises sensor means for tracking the location of said sheets relative to said ejecting means, said sensor means interfaced with said control means.

11. A billing statement system according to claim 8, wherein said folder means further comprises input means for providing said billing packet to said plurality of roller means, and output means for removing folded billing statements from said roller means.

* * * * *